US007556183B1

(12) United States Patent
Liang et al.

(10) Patent No.: US 7,556,183 B1
(45) Date of Patent: Jul. 7, 2009

(54) CONTROL DEVICE FOR NAIL HITTING OF PNEUMATIC NAIL GUNS

(75) Inventors: Chia-Sheng Liang, Taipei Hsien (TW); Ti-Tsung Wu, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 55 days.

(21) Appl. No.: 12/025,070

(22) Filed: Feb. 4, 2008

(51) Int. Cl.
*B25C 5/00* (2006.01)

(52) U.S. Cl. ..... 227/130; 227/112; 227/129

(58) Field of Classification Search ..... 227/130, 227/112, 129; 173/168, 169
See application file for complete search history.

(56) References Cited

U.S. PATENT DOCUMENTS

| | | | | |
|---|---|---|---|---|
| 5,779,127 | A * | 7/1998 | Blacket et al. | 227/107 |
| 7,290,691 | B1 * | 11/2007 | Wen | 227/8 |
| 7,308,995 | B2 * | 12/2007 | Uchiyama et al. | 227/8 |
| 7,395,954 | B2 * | 7/2008 | Wen | 227/130 |
| 2007/0075113 | A1 | 4/2007 | Tillinghast et al. | |
| 2007/0251972 | A1 * | 11/2007 | Lee | 227/130 |
| 2008/0023520 | A1 * | 1/2008 | Marshall et al. | 227/130 |
| 2008/0135598 | A1 * | 6/2008 | Burke et al. | 227/130 |
| 2008/0185058 | A1 * | 8/2008 | Wakabayashi et al. | 137/613 |
| 2008/0185416 | A1 * | 8/2008 | Deng et al. | 227/8 |
| 2008/0302848 | A1 * | 12/2008 | Aguirre et al. | 227/83 |

FOREIGN PATENT DOCUMENTS

| | | |
|---|---|---|
| TW | M312401 | 5/2007 |

* cited by examiner

*Primary Examiner*—Brian D Nash

(57) ABSTRACT

A control device for hitting nails of a pneumatic nail gun includes a control valve. The control valve is arranged in a main air flow passage between a trigger of the nail gun and the main air valve. The control valve has valve cover to open or close the main air flow passage. A valve bolt is slidably disposed in the valve cover. The valve bolt can be driven by the high pressure air to move down. A safety slide pole is slidably disposed in a gun body for blocking or releasing the valve bolt to move down. Therefore, a position of the safety slide pole can reflect a height of a work part which to be nailed. The valve bolt can detect the height reflected by the safety slide pole to guide in the high pressure air from the main air flow passage to hit nails. Thus, the controlling stability is enhanced. The components are also simplified.

14 Claims, 19 Drawing Sheets

CONTROL DEVICE FOR NAIL HITTING OF PNEUMATIC NAIL GUNS

BACKGROUND

The present invention relates to control devices for nail hitting of pneumatic nail guns, and particularly to a high pressure air control valve disposed in a main air flow passage between a trigger valve and a main valve.

Generally, when a nail gun is used for nailing a work part, such as a washer, via its through hole to a work piece a back end of the nail is usually exposed onto the work piece so as to fix the work part. In order to selectively control the nail hitting in light of the different work parts, a control device is usually arranged in the main air flow passage between a trigger valve and a main air valve. A knocking base positioned below a bottom end of a safety slide pole abuts against the work part for detecting a height of the through hole of the work part. So the high pressure air is controlled to open the main air valve to hit nails.

One kind of pneumatic nail gun with control device for nail hitting is described in US Patent Publication No. 20070075113. The pneumatic nail gun has a cam follower driven by a movable portion, and a body portion is capable of being blocked or released by the cam follower. The body portion can be blocked or released by the movable portion to control the high pressure air to open the main air valve to hit nails. However, the cam follower is exposed between the body portion and the movable portion. The cam follower will accumulate dust to affect the operation performance of the nail gun. This nail gun expressly has a complex structure.

Further, a pneumatic nail gun with a control device providing a safety design on the hitting process is described in Taiwan Patent Publication No. M312401. The nail gun has a hollow valve bolt being driven or released by a safety slide pole, and a valve cover which can exhaust the high pressure air to the outer atmosphere through opening or closing the main air flow passage controlled by the valve bolt. The safety slide pole is first driven to move up to block the valve bolt. The high pressure air in the main air flow passage is then exhausted to the outer atmosphere by pulling the trigger. The main air valve can be controlled to hit nails. However, the passage configuration between the hollow valve bolt and the valve cover is complicated. There is not enough air being collected in the main air chamber and the main air flow passage. The stability is not good.

BRIEF SUMMARY

To overcome above problems, a control device of a pneumatic nail gun with a control valve is provided for selectively controlling the nail hitting in light of the different work parts.

For this purpose, a pneumatic nail gun according to an embodiment of the present invention has a trigger valve attached on a gun body of the nail gun. The high pressure air is introduced from a main air flow passage to urge to open a main air valve to hit nails. A safety slide pole is disposed in the gun body. A control valve is disposed in the main air flow passage between the trigger valve and the main air valve. The control valve includes a valve base, a valve cover and a solid valve bolt.

The valve base defines an inlet opening in a top portion thereof. The inlet opening communicates with the trigger valve via the main air flow passage. The valve base defines at least one outlet opening in a side wall thereof. The at least one outlet opening communicates with the main air valve via the main air flow passage.

The valve cover is disposed in the valve base. The valve cover defines an upper neck hole and a lower through hole. The upper neck hole communicates with the lower through hole. A diameter of the through hole is larger than a diameter of the neck hole. The neck hole communicates with the inlet opening. The valve cover defines at least one air guiding hole in an inner wall thereof communicating with the outlet opening. A bottom air chamber communicating with the through hole is disposed between a bottom valve cover and an inner wall of the valve base.

The valve bolt is slidably disposed in the valve cover. The valve bolt has a stressed end face at a top portion thereof adjacent to the inlet opening. The valve bolt is capable of moving down driven by the high pressure air exerting on the stressed end face. A bottom portion of the valve bolt extends to a position abutting to a top portion of the safety slide portion. The safety slide pole is capable of moving down pushed by the valve bolt or moving up released by the bolt valve to an original position. The valve bolt has a valve plug at an outer wall of the valve bolt. The valve plug is slidably disposed in the neck hole on top of the air guiding hole to block the high pressure air.

When the safety slide pole moves down to a predetermined height, the valve bolt moves down with the safety slide pole. The valve plug moves into the neck hole below the air guiding hole. The air communication between the inlet opening and the outlet opening is opened. The air communication between the inlet opening and the bottom air chamber is closed. The high pressure air is guided into the main air flow passage to hit nails. When the safety slide pole moves down to a position which is higher than the predetermined height, the valve plug moves into the neck hole on top of the air guiding hole. The air communication between the inlet opening and the outlet opening is closed. The air communication between the inlet opening and the bottom air chamber is open. The main air flow passage is shut off. When the safety slide pole moves down to a position which is lower than the predetermined height, the valve plug moves into the through hole. The air communication between the inlet opening and the bottom air chamber is open. The high pressure air is guided into the bottom air chamber to drive the valve cover to move up. The air communication between the inlet opening and the outlet opening. The air guiding hole and the outlet opening are closed, and the main air flow passage is shut off.

The valve cover and the valve bolt are driven by the high pressure air. The high pressure air can enhance the stability in process of the nail hitting. The through hole and the neck hole with different diameters are provided for an air passageway. The solid valve bolt is used for opening or closing the air passageway. Therefore, the configuration of the valve cover, the valve bolt and the air passageway is simplified. Also there is no exposed component configured between the safety slide pole and valve bolt, so the configuration is simplified.

In this invention, a plug portion is formed on an outside wall of the valve cover. The plug portion is slidably arranged in the valve base. The plug portion is capable of cutting off the air communication between the inner wall of the valve base and an outer wall of the valve cover. When the air communication between the air guiding hole and the outlet opening is open. The plug portion is capable of preventing the high pressure air from leaking between the air guiding opening and the outlet opening. The plug portion includes two sealing gaskets. The air guiding hole is defined between the two sealing gaskets.

An annular intermediate chamber is arranged between the outer valve cover which positioned below the plug portion and the inner wall of the valve base. At least one outlet hole is defined in a side wall of the valve base below the outlet opening. The at least one outlet hole communicates the intermediate chamber with the outer atmosphere. When the valve cover moves up to close the communication between the inlet opening and the outlet opening. The communication between the outlet opening and the outlet hole, and the communication between the intermediate chamber and the outlet hole are open.

The valve cover is slidably disposed in the valve base. The valve cover may return to an original position by the rebounding of a spring attached thereon. A circular portion extends from a bottom portion of the valve cover. A first spring is attached to the cover. The first spring abuts to the inner wall of the valve base and the circular portion.

The valve bolt is slidably disposed in the valve cover. The valve bolt may return to the original position by the rebounding of a spring attached thereon. A cover is disposed below a bottom portion of the valve bolt. A second spring is attached to the valve bolt, and the second spring abuts to the valve plug and the cover.

A fifth spring is attached between a side portion of the safety slide pole and a bottom portion of the gun body. The fifth spring urges the safety slide pole to move up to abut against the bottom portion of the valve bolt.

In another embodiment of the present invention, the inlet opening and the outlet opening are connected. The air guiding hole in an inner wall of the neck hole is omitted. When the safety slide pole moves down to a predetermined height, the valve bolt moves down with the safety slide pole. The air communication between the inlet opening and the bottom air chamber is closed. The high pressure air is guided into the bottom air chamber to drive to hit nails via inlet opening and the outlet opening. When the safety slide pole moves down to a position which is lower than the predetermined height, the valve plug moves into the through hole. The communication between the inlet opening and the bottom air chamber is open in order to guide the high pressure air into the bottom air chamber to drive the valve cover to move up. The air communication between the inlet opening and the outlet opening is closed. The main air flow passage is shut off.

A plug portion is formed on an outside wall of the valve cover. The plug portion is slidably arranged in the valve base. The plug portion is capable of cutting off the air communication between the inner wall of the valve base and an outer wall of the valve cover to open or close the air communication between the inlet opening and the outlet opening. The plug portion includes a sealing gasket. When the sealing gasket moves down to a position below the outlet opening driven by the valve cover, the air communication between the inlet opening and the outlet opening is open. When the sealing gasket moves up to a position on top of the outlet opening driven by the valve cover, the air communication between the inlet opening and the outlet opening is closed.

The valve cover defines at least one end slot or annular gap in the outer wall of a top portion thereof. The at least one the end slot or annular gap communicates with the inlet opening and the outlet opening. At least one air guiding hole is defined in an inner wall of the neck hole. The at least one air guiding hole communicates with the outlet opening. The valve plug is slidably disposed in the neck hole below the air guiding hole for blocking the high pressure air in order to communicate the inlet opening with the outlet opening, and to communicate the air guiding hole with the outlet opening.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
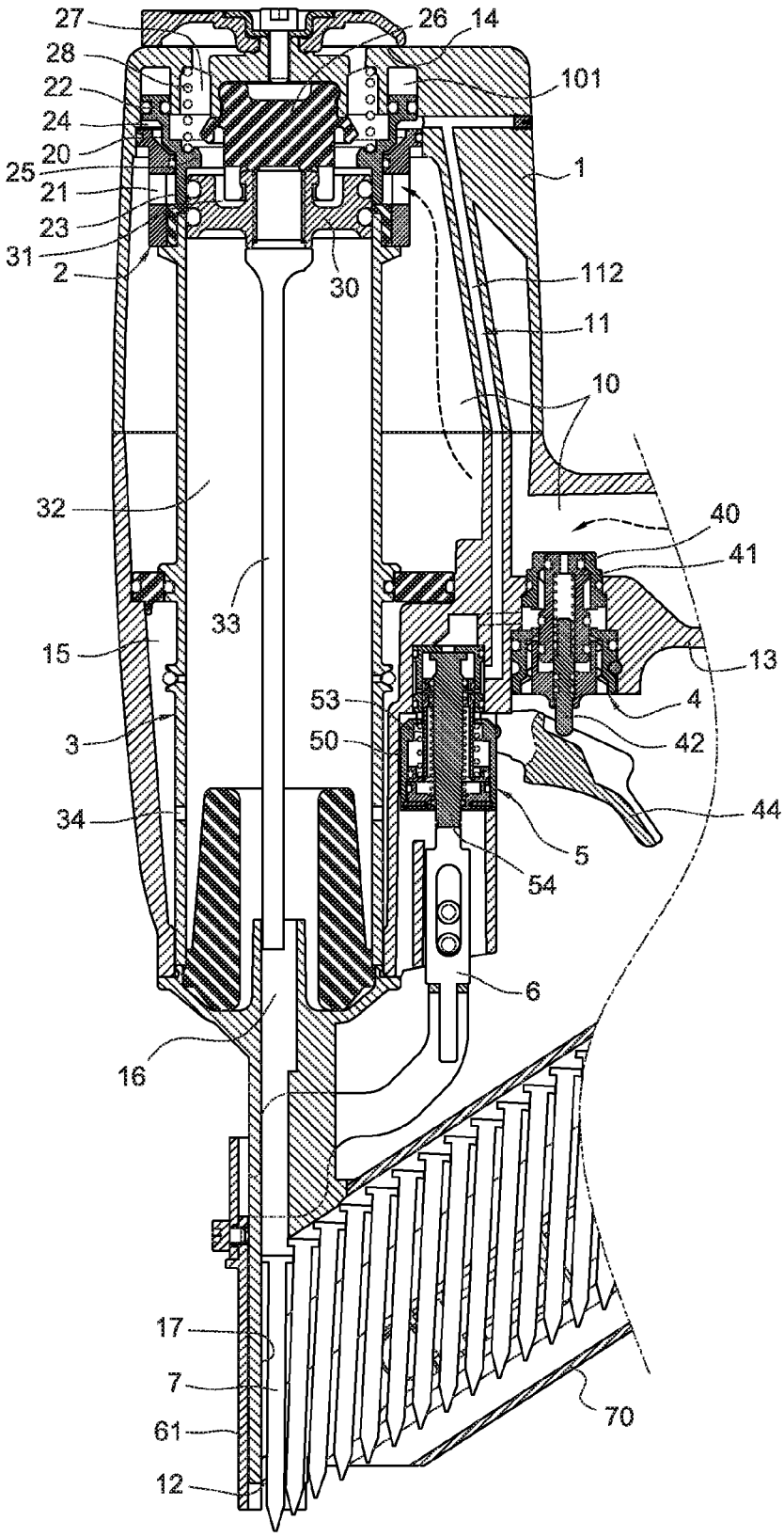
FIG. 1 is a cross-sectional view of a pneumatic nail gun according to a preferred embodiment of the present invention.
Figure 2:
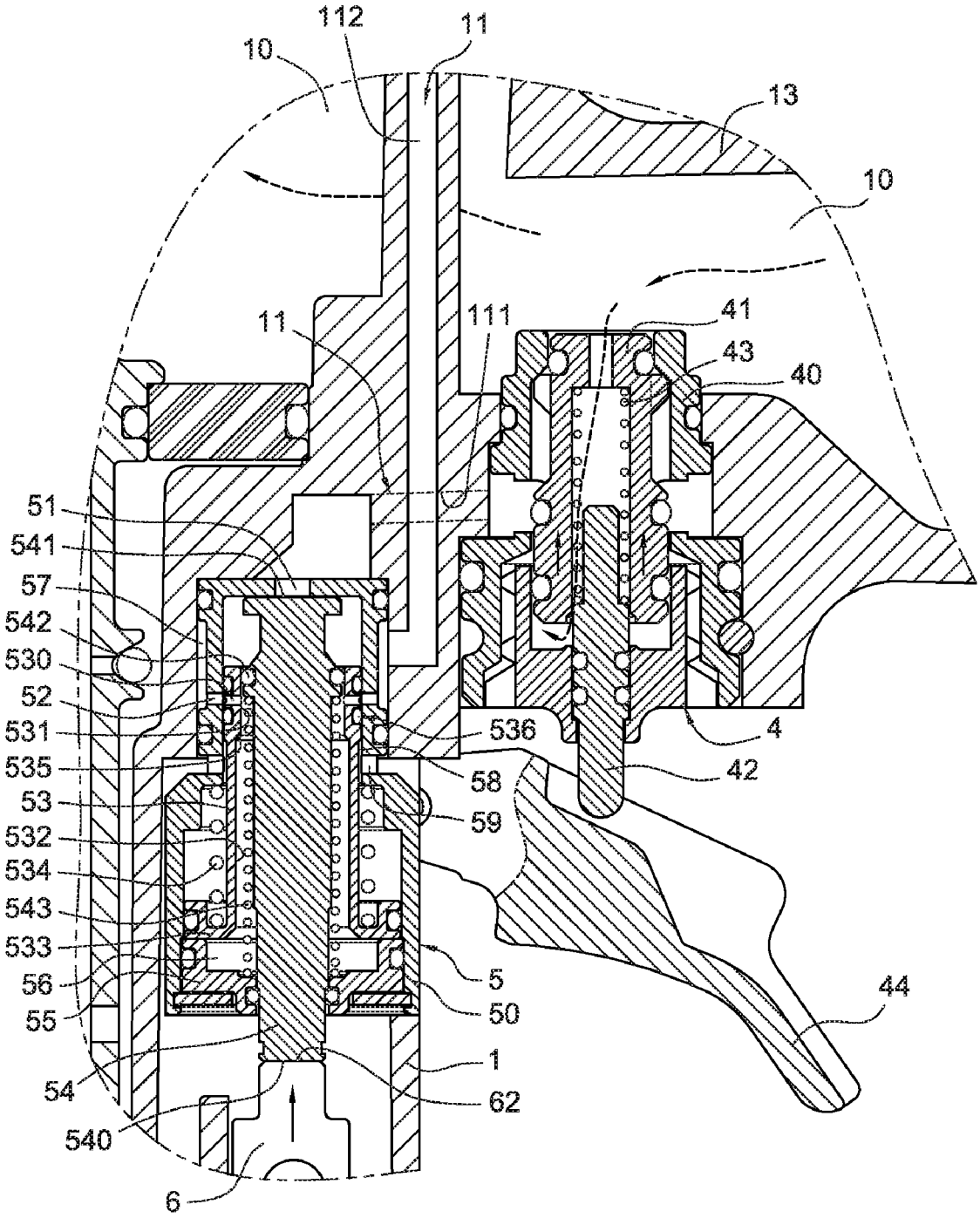
FIG. 2 is an enlarged view of the pneumatic nail gun of FIG. 1.
Figure 7:
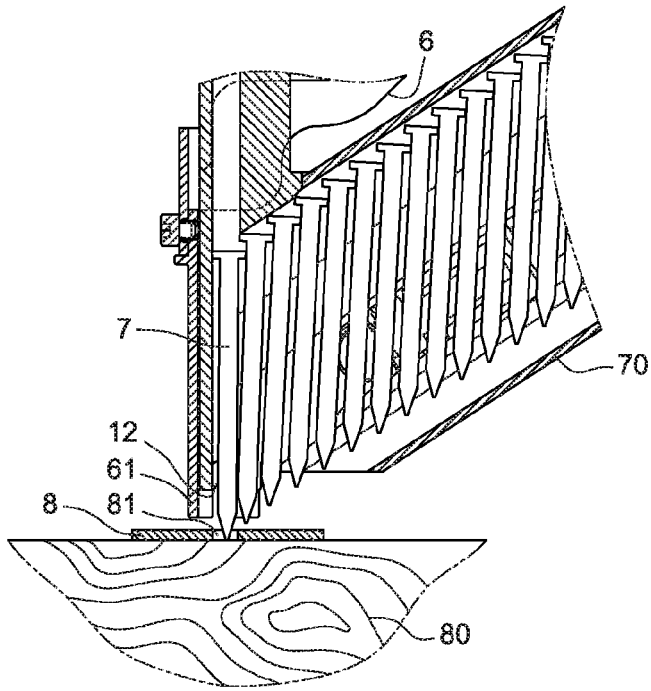
FIG. 7 is cross-sectional view of a knocking base of the pneumatic nail gun according to a preferred embodiment of the present invention, showing a state of operation.
Figure 8:
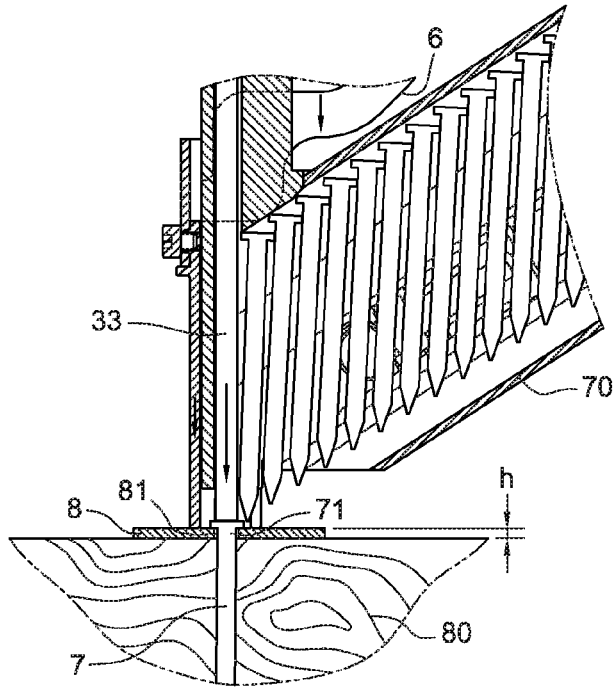
FIG. 8 is another cross-sectional view of the knocking base of the pneumatic nail gun according to a preferred embodiment of the present invention, showing a state of operation.

Referring to FIG. 1 and FIG. 2, a control device for nail hitting of a pneumatic nail gun according to a first embodiment of the present invention is illustrated. The pneumatic nail gun includes a gun body 1. A main air flow passage 11 is formed to connect a pressure collecting chamber 10 to a main air valve 2. The pressure collecting chamber 10 can continuously collect high pressure air to maintain a constant air pressure therein. The main air valve 2 is disposed on top of a cylinder 3 of the gun body 1. The main air valve 2 is actuated by the high pressure air from the main air flow passage 11 to open the pressure collecting chamber 10, so that the high pressure air from the pressure collecting chamber 10 can enter into the cylinder 3 (shown in FIG. 10). The gun body 1 has a trigger valve 4 connecting to the main air flow passage 11. The trigger valve 4 can drive the main air valve 2 to open by introducing high pressure air from the pressure collecting chamber 10. The high pressure air is introduced from the pressure collecting chamber 10 to the main air flow passage 11 to drive the nail gun to hit nails. The gun body 1 further has a safety slide pole 6 and a knocking base 61 at a bottom portion thereof for abutting against the work part (shown in FIG. 7 and FIG. 8). The knocking base 61 extends out of a shooting mouth 12 at the bottom portion thereof. A control valve 5 is constructed and arranged at the main air flow passage 11 between the trigger valve 4 and the main air valve 2. The control valve 5 divides the main air flow passage 11 into a front air flow passage 111 which is connected to the trigger valve 4 and the pressure collecting chamber 10, and a back air flow passage 112 which is connected to the main air valve 2.

The gun body 1 defines a hitting channel 17 (shown in FIG. 1) at a bottom portion thereof. The hitting channel 17 communicates with a nail magazine 70 which has a plurality of nails loading therein. The gun body 1 has a handle 13. The pressure collecting chamber 10 is formed in the handle 13, and is positioned outside the main air valve 2 and the cylinder 3. The main air valve 2 has a valve body 20. The valve body 20 defines a plurality of air holes 21 in an outer wall thereof to communicate with the cylinder 3. A sliding sleeve 22 is slidably arranged on top of the valve body 20. A circular upper pressure collecting chamber 101 is surrounded by a top portion of the sliding sleeve 22 and an inner wall of the gun body 1. The upper pressure collecting chamber 101 is connected to the pressure collecting chamber 10. A circular lower valve 23 extends from a bottom portion of the sliding sleeve 22 into the valve body 20 to block the air holes 21. High pressure air can be collected in the upper collecting chamber 101 to drive the sliding sleeve 22 to move down and drive the lower valve 22 to shut off the air holes 21. A main air chamber 24 is surrounded by the sliding sleeve 22, a valve body 20 and the inner wall of the gun body 1, and is connected to the back air flow passage 112. The main air chamber 24 can gather the high pressure air which provided by the back air flow passage 112. A pushing force exerts on the sliding sleeve 22 to move up by the high pressure air from the main air chamber 24 is larger than a pushing force exerts on the sliding sleeve 22 to move down by the high pressure air from the upper pressure collecting chamber 101. Thus, the high pressure air can drive the sliding sleeve 22 with the lower valve 23 to move up to open the air holes 21 (shown in FIG. 10). The main air valve 2 has an air-tight ring 26 assembled on top of the cylinder 3 at the inner wall of the gun body 1. The sliding sleeve 22 is set around the air-tight ring 26. An exhausting vent 14 is defined in a top portion of the gun body 1. An exhausting passage 27 is defined to connect to the exhausting vent 14 and an inner side of the cylinder 3 between the sliding sleeve 22 and the air-tight ring 26. An annular upper valve 25 is formed on an inner surface of the sliding sleeve 22. A third spring 28 is provided in the exhausting passage 27 abutting to the inner wall of the gun body 1 and the upper valve 25 for assisting the high pressure air from the upper pressure collecting chamber 101 to drive the sliding sleeve 22 to move down. The upper valve 25 can abut against an outer wall of the air-tight ring 26 to shut off the exhausting passage 27 when the upper valve 25 moves up with the sliding sleeve 22.

The cylinder 3 has a hitting piston 30 slidably installed therein (shown in FIG. 1). The cylinder 3 is divided into an upper cylinder housing 31 and a lower cylinder housing 32. The upper cylinder housing 31 is connected to the exhausting passage 27. A hitting pole 33 is attached to a bottom portion of the piston 30. A return chamber 15 is formed at the position between the cylinder 3 and the inner wall of the gun body 1. The cylinder 3 defines a plurality of air holes 34, which communicates to the return chamber 15.

Figure 9:
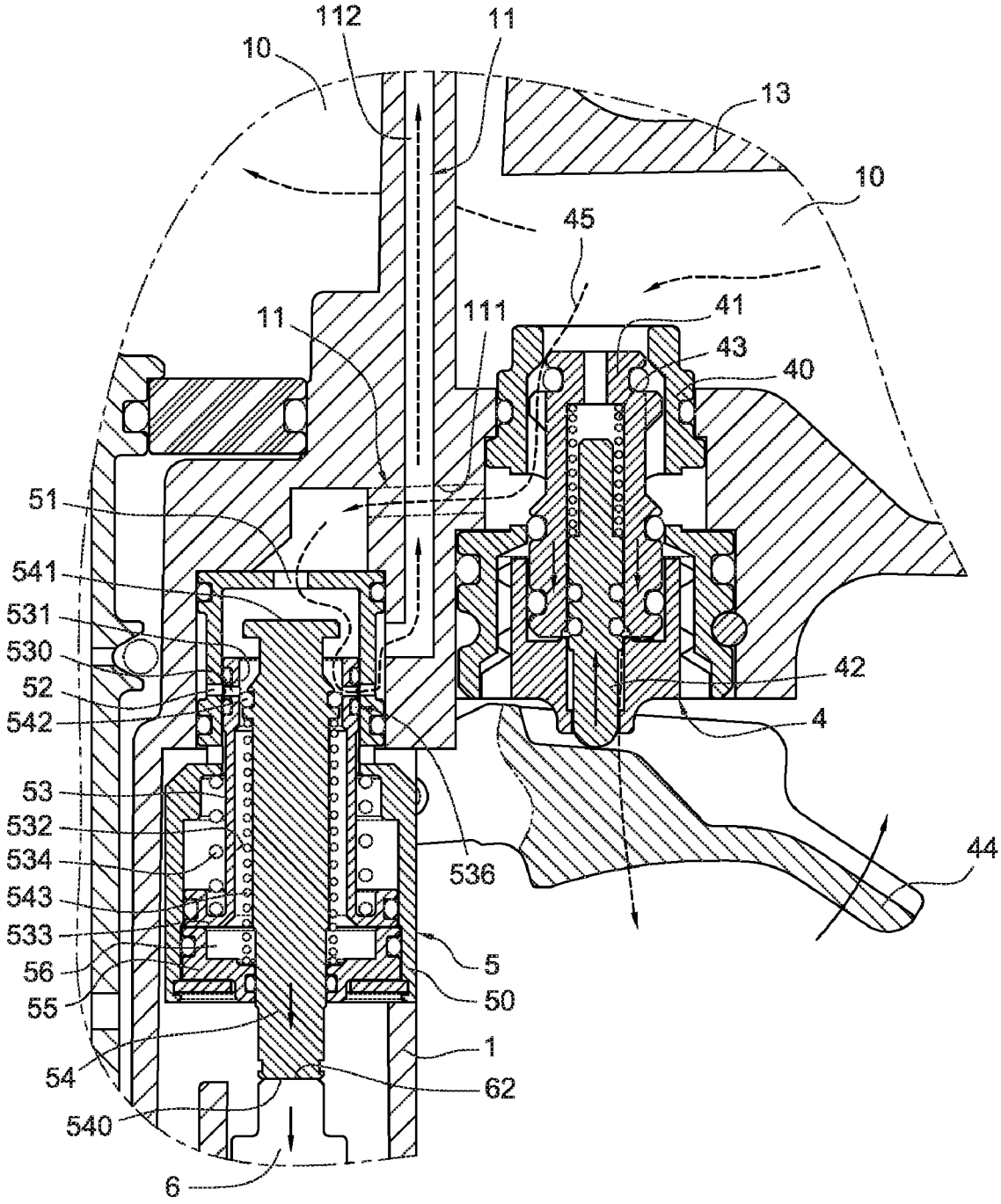
FIG. 9 is similar to FIG. 2, but showing a state of operation.
Figure 11:
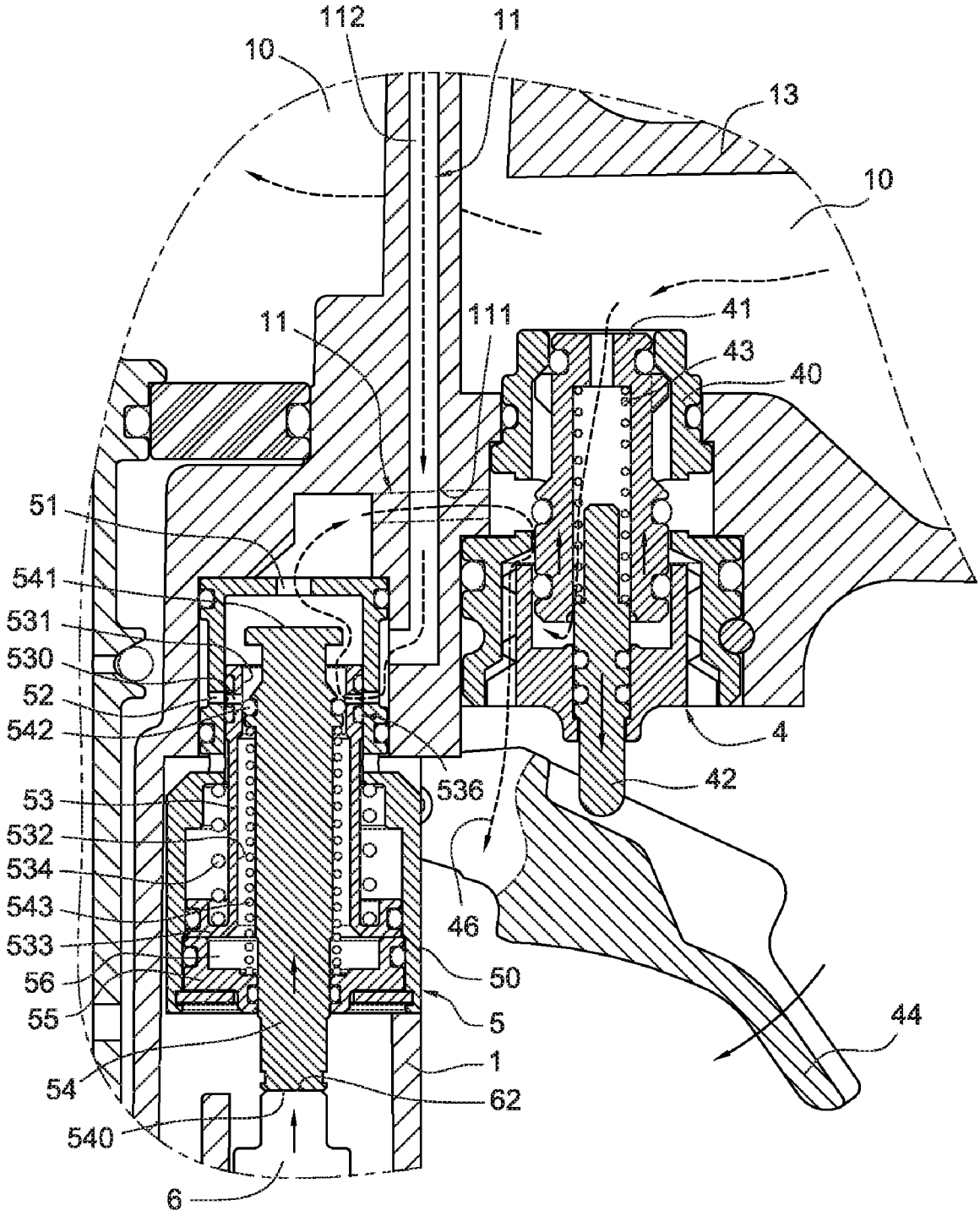
FIG. 11 is similar to FIG. 2, but showing another state of operation.
Figure 12:
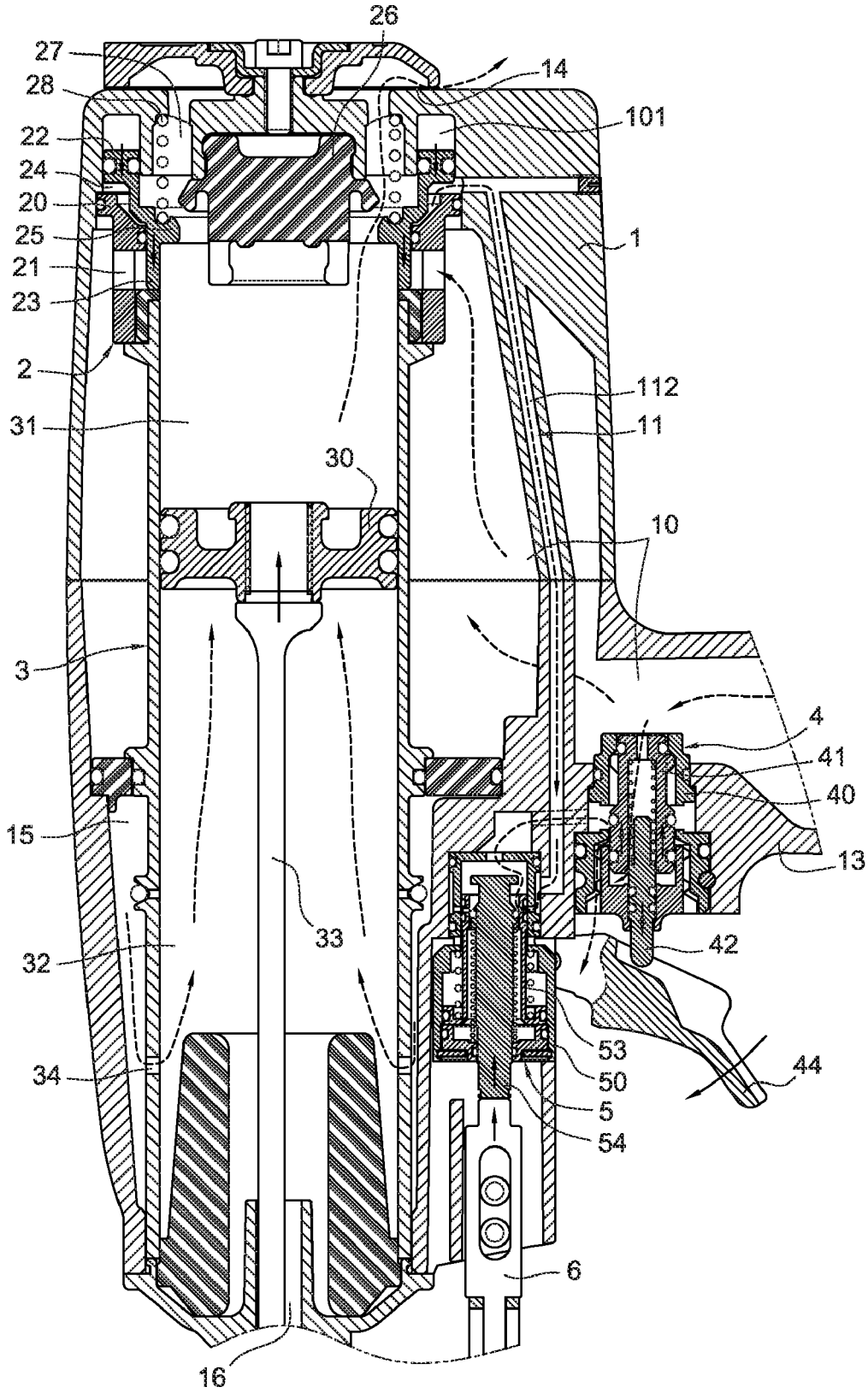
FIG. 12 is similar to FIG. 1, but showing another state of operation.
Figure 13:
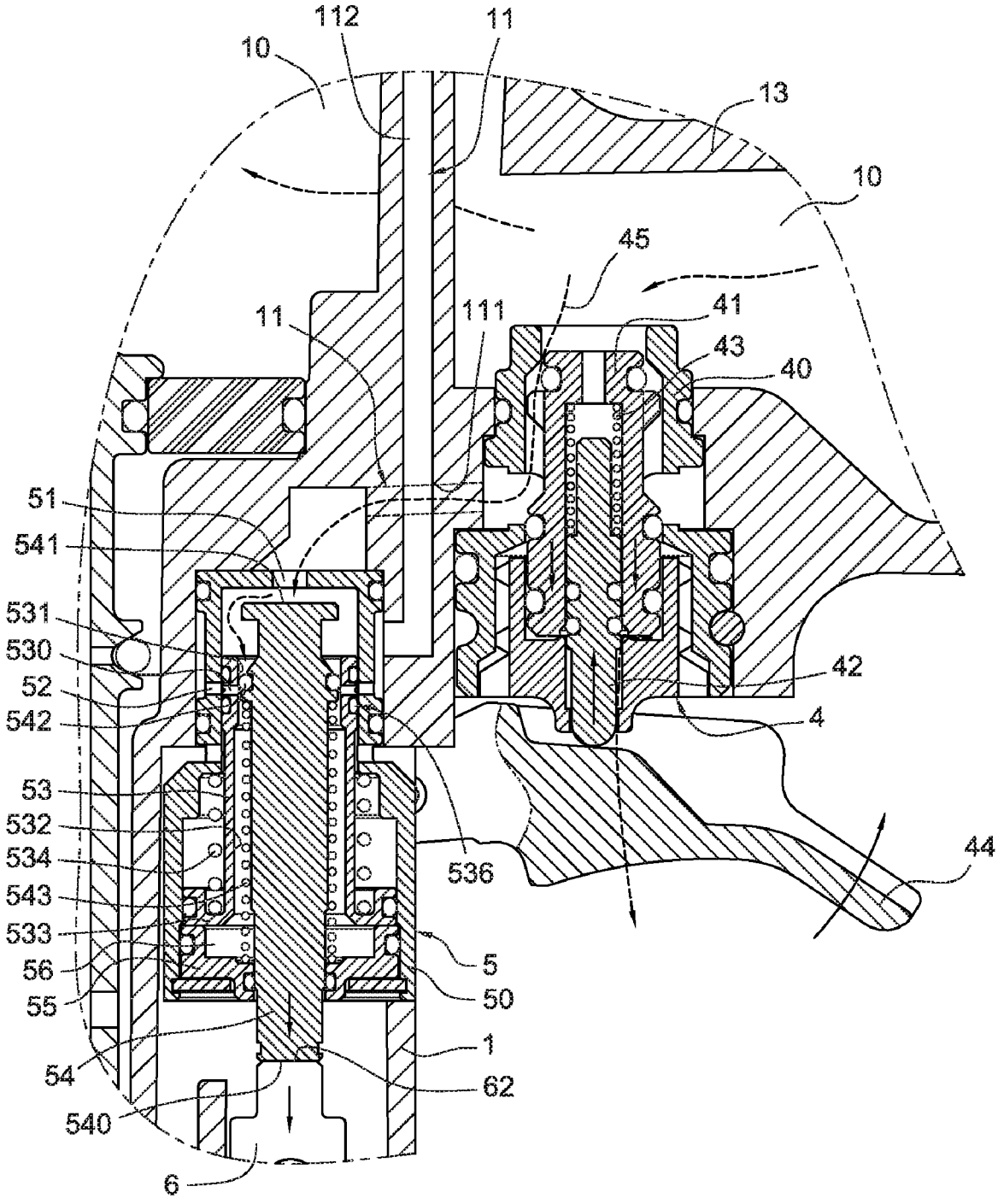
FIG. 13 is similar to FIG. 2, but showing a third state of operation.

The trigger valve 4 has a base 40 (shown in FIG. 1 and FIG. 2). A shuttling valve 41 is slidably installed in the base 40. A valve pole 42 is disposed in the shuttling valve 41 to be pressed or to be released to move up or down. A fourth spring 43 is disposed between the shuttling valve 41 and the valve pole 42. The valve pole 42 has a trigger 44 attached at a bottom portion thereto, which is also pivotably attached to the gun body 1. The valve pole 42 can be driven to move up by pulling the trigger 44 (shown in FIG. 9), and can return to the previous position by releasing the trigger 44 (shown in FIG. 11). The trigger valve 4 defines an air flow passage 11, and an air outlet passage 46, which connects to the main air flow passage 11 and the outer atmosphere.

The control valve 5 includes a valve cover 53 and a solid valve bolt 54. The valve base 50 defines an inlet opening 51 in a top portion thereof to communicate to the trigger valve 4 via the front air flow passage 111, and defines at least one outlet opening 52 in a side wall thereof to communicate to the main air valve 2 via the back air flow passage 112.

The valve cover 53 is slidably installed in the valve base 50. The valve cover 53 defines a upper neck hole 531 and a lower through hole 532 (shown in FIG. 6). The upper neck hole 531 communicates with the lower through hole 532. A diameter D2 of the through hole 531 is larger than a diameter D1 of the neck hole 531. The neck hole 531 is connected to the inlet opening 51. At least one air guiding hole 530 is defined in an inner wall of the neck hole 531 to communicate to the outlet opening 52. A bottom air chamber 56 is formed at the position between a bottom portion of the valve cover 53 and an inner wall of the valve base 50 to communicate to the through hole 532.

The valve bolt 54 is slidably disposed in the valve cover 53. The valve bolt 54 has a stressed end face at a top portion thereof adjacent to the inlet opening 51. The valve bolt 54 can be driven to move down by the high pressure air exerting on the stressed end face. A pushing surface 540 is formed at a bottom portion of the valve bolt 54 abutting to a top portion of the safety slide pole 6. The safety slide pole 6 can be pushed to move down by the pushing surface 540 (shown in FIG. 10), and be released to move to the originally position. A valve plug 542 configured for a sealing gasket is set around an outer wall of the valve bolt 54 and slidably disposed in the neck hole 531 for blocking the high pressure air coming from the pressure collecting chamber 10.

Figure 14:
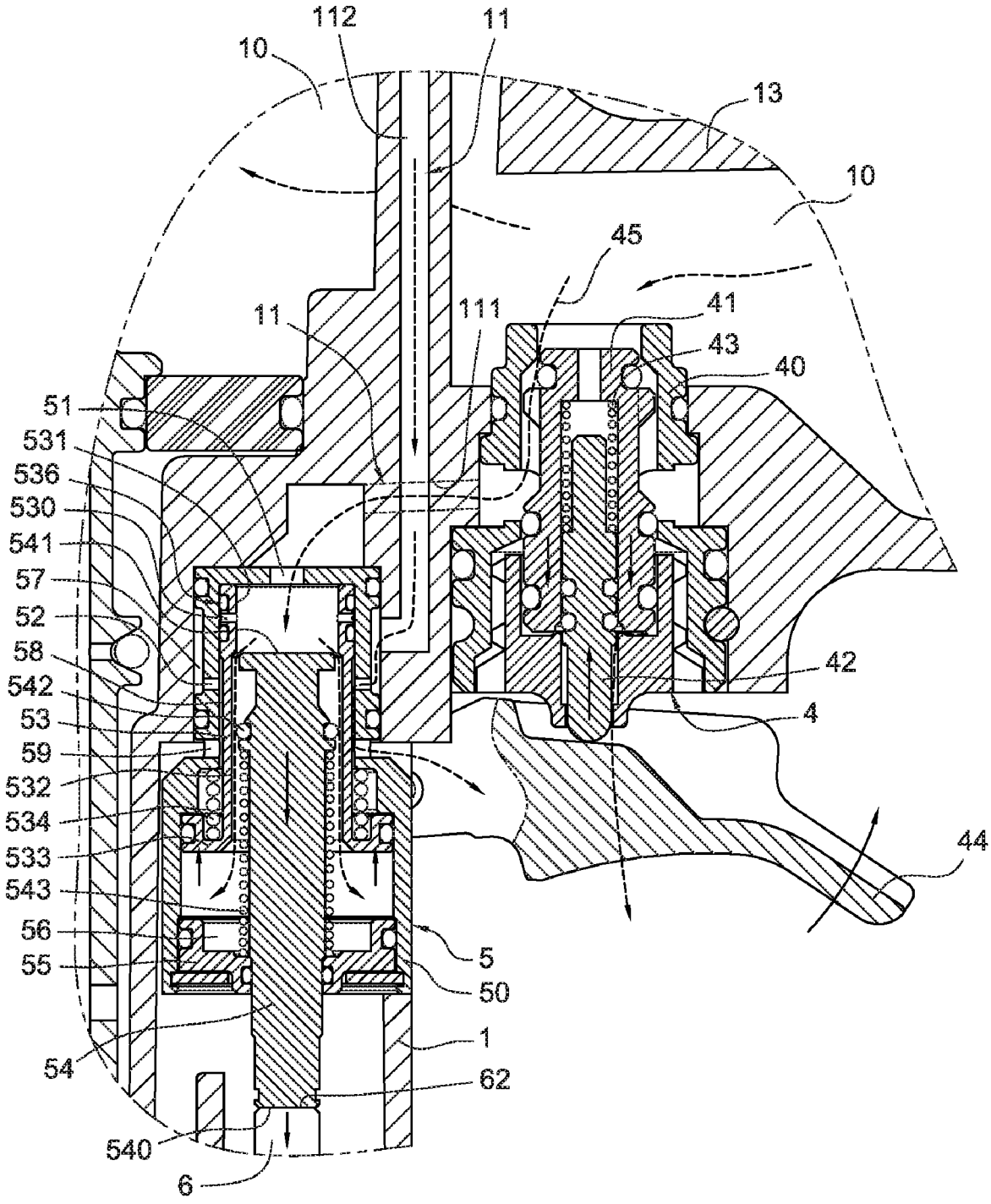
FIG. 14 is similar to FIG. 2, but showing a fourth state of operation.

For more details of the first embodiment of the present invention, the valve base 50 further has a cover 55 connected thereto (shown in FIG. 2). A lower air chamber 56 is formed at the position between a bottom portion of the valve cover 53 and the cover 55 for collecting the high pressure air coming from the front air flow passage 111, inlet opening 51, neck hole 531 and the through hole 532 to drive the valve cover 53 to move up (shown in FIG. 14). An annular air chamber 57 is formed surrounding an outer wall of the valve base 50. The annular air chamber 57 is disposed at a passageway between the outlet opening 52 and the back air flow passage 112.

Figure 6:
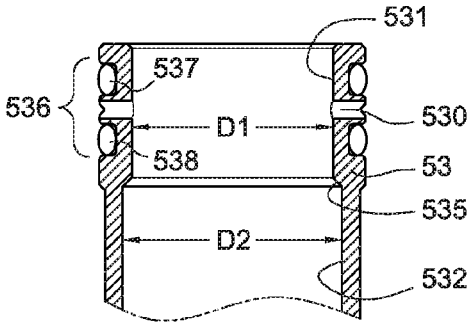
FIG. 6 is a cross-sectional view of a valve cover of the pneumatic nail gun according to a preferred embodiment of the present invention.
Figure 5:
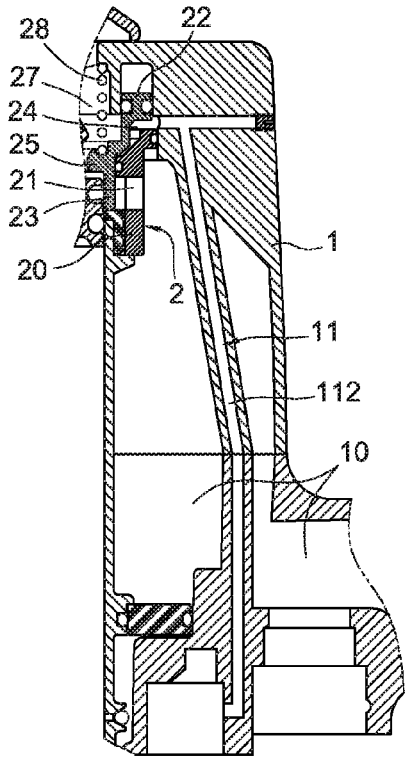
FIG. 5 is a cross-sectional view of a back air flow passage of the pneumatic nail gun according to a preferred embodiment of the present invention.

The valve cover 53 has a plug portion 536 on an outer portion thereof (shown in FIG. 2 and FIG. 6). The plug portion 536 is slidably disposed in the valve base 50 for blocking the high pressure air between an inner wall of the valve base 50 and the outer wall of the valve cover 53. The plug portion 536 can prevent the high pressure air from leaking between the air guiding hole 530 and the outlet opening 52. The plug portion 536 includes two sealing gaskets 537 and 538. The air guiding hole 530 is defined between the two sealing gaskets 537 and 538.

A circular portion 533 is formed on a bottom portion of the valve cover 53. An annular intermediate chamber 58 is formed at the position surrounded by the outer wall of the valve cover 53 at a bottom portion of the plug portion 536, an upper portion of the circular portion 533 and the inner wall of the valve base 50. At least one outlet hole 59 is defined in a side wall of the valve base 50 below the outlet opening 52 for communicating with the outer atmosphere. While the valve cover 53 is driven to move up, the fluid communication between the air guiding hole 530 and the outlet hole 59 is shut off (shown in FIG. 14). The fluid communication between the outlet opening 52, and the outlet hole 59 is opened via the intermediate chamber 58.

The valve cover 53 is slidably installed in the valve base 50. The valve cover 53 can return to an original position by the rebounding of a spring attached thereon. The valve cover 53 has a first spring 534 attached thereon (shown in FIG. 2). The first spring 534 abuts to the inner wall of the valve base 50 and the circular portion 533 inside the intermediate chamber 58. Thus the valve cover 53 is pressed by the first spring 534. The strength being exerted on the valve cover 53 to move up by the high pressure air from the bottom air chamber 56 is larger than the strength generated from the first spring 534. A slope 535 connects the neck hole 531 to the through hole 532.

Figure 3:
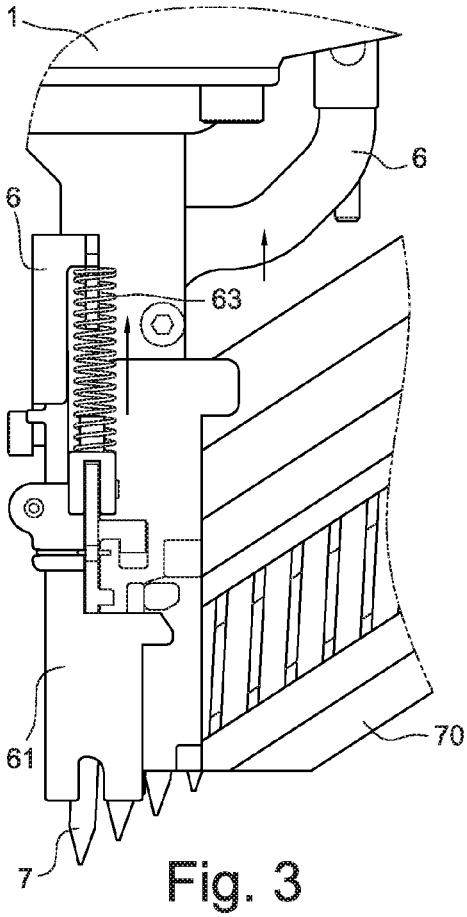
FIG. 3 is a constructional view of a safety slide pole of the pneumatic nail gun according to a preferred embodiment of the present invention.
Figure 4:
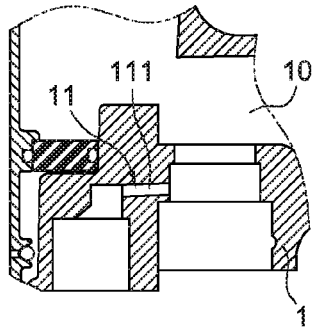
FIG. 4 is a cross-sectional view of a front air flow passage of the pneumatic nail gun according to a preferred embodiment of the present invention.

The valve bolt 54 is slidably installed in the valve cover 53. The valve bolt 54 can return to an original position by the rebounding of a spring attached thereon. The valve bolt 54 has a second spring 543 attached thereon (shown in FIG. 2). The second spring 543 abuts to the valve plug 542 and the cover 55. Thus the valve bolt 54 is pressed by the second spring 543. The strength being exerted on the valve bolt 54 by the high pressure air from the inlet opening 51 to drive the valve bolt to move downward is larger than the strength generated from the second spring 543. A fifth spring 63 is disposed at the position between the safety slide pole 6 and a bottom portion of the gun body 1 (shown in FIG. 3). The fifth spring 63 can push the safety slide pole 6 to move up to a top portion 62 so that the safety slide pole 6 can abut on the pushing surface 540 of the valve bolt 54. The knocking base 61 can be driven by an upwardly movement of the safety slide pole 6 for exposing the nail 7 from the hitting channel 17 outside the shooting mouth 12 and the knocking base 61.

Figure 10:
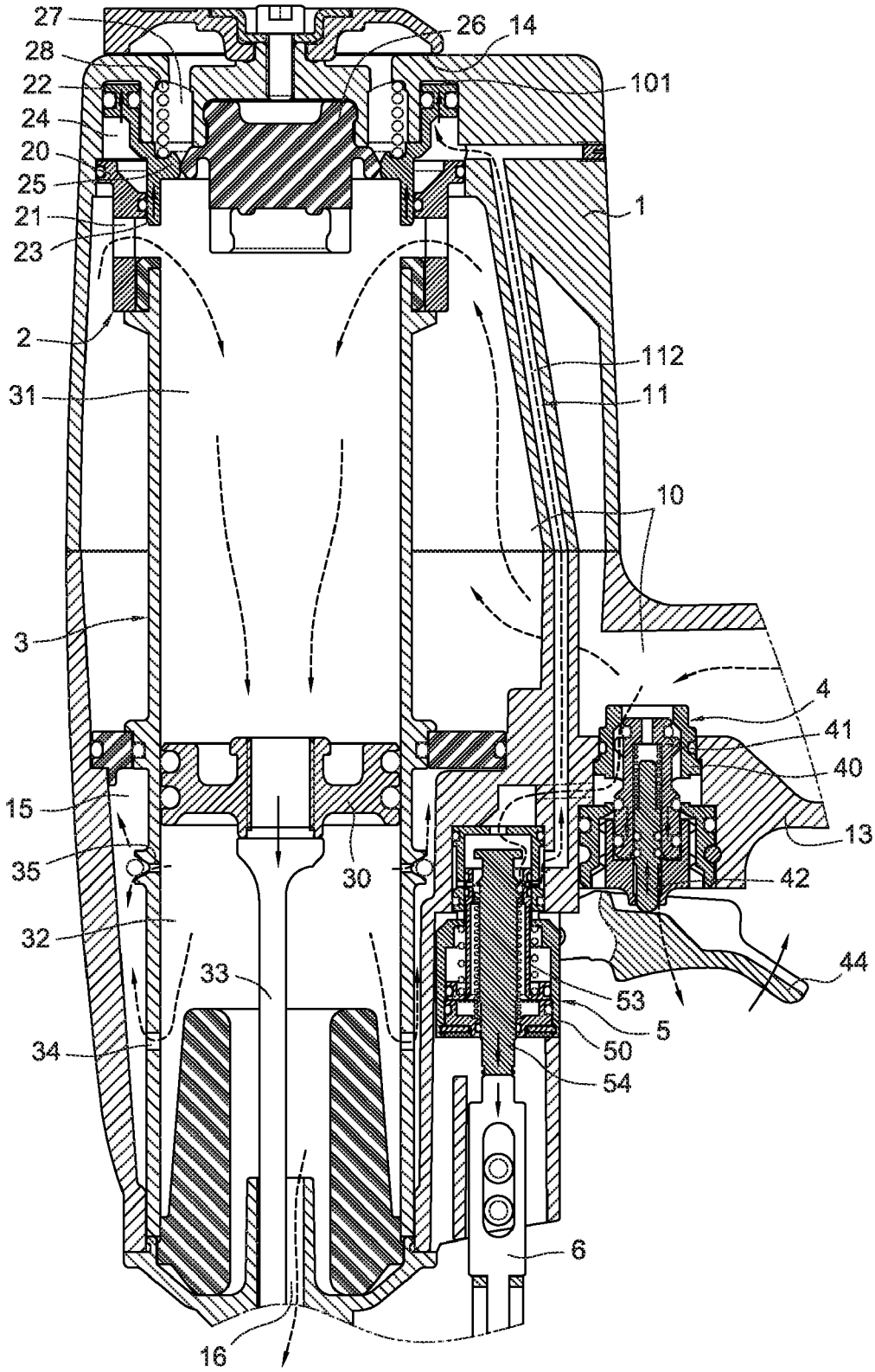
FIG. 10 is similar to FIG. 1, but showing a state of operation.

Referring also to FIG. 7 to FIG. 14, when using the pneumatic nail gun, a work part 8 can be nailed to a work piece 80 through a through hole 81 which defined in the work part 8. The nail 7 which exposed outside the shooting mouth 12 and the knocking base 61 is positioned in a through hole 81 of the work part 8 (shown in FIG. 7). The knocking base 61 does not contact the work piece 8. When the trigger 44 is pulled to open the trigger valve 4 (shown in FIG. 9), the high pressure air from the pressure collecting chamber 10 enters into the inlet opening 51 via an air inlet passage 45 and the front air flow passage 111. The high pressure air exerts a press on a stressed end surface 541 to drive the valve bolt 54 to move down. The top portion 62 of the safety slide pole 6 is then pushed by the pushing surface 540 of the valve bolt 54 to move down. The safety slide pole 6 is then pushed by the pushing surface 540 of the valve bolt 54 to move down. The safety slide pole 6 and the knocking base 61 is blocked by the work part 8 (shown in FIG. 8) and stopped at a predetermined height h. The height h is equal to a thickness of the work part 8 or equal to a height of the through hole 81. The height h can be advantageously selected from 1 mm (millimeter) to 3 mm. At the same time, the valve bolt 54 is stopped by the safety slide pole 6 so that the valve plug 542 moves into the neck hole 531 blow the air guiding hole 530, and the inlet opening 51 and the outlet opening 52 are communicated. The fluid communication between the inlet opening 51 and the bottom air chamber 56 is shut off. As a result, the high pressure air can be introduced into the main air chamber 24 of the main air valve 2 via the back air flow passage 112 (as shown in FIG. 10). The sliding sleeve 22 drives the lower valve 23 to move up to open the air hole 21, and the upper valve 25 is also driven by the sliding sleeve 22 to move up to close the exhausting passage 27. The high pressure air from the pressure collecting chamber 10 enters into the upper cylinder housing 31 via the air hole 21. The piston 30 drives the hitting pole 33 to move down to hit the nail 7. The nail 7 is hit into work piece 80 for fastening the work piece 80 through the through hole 81. A distal end 71 is exposed from the through hole 81. When the piston 30 moves down, a proportion of the air from the lower cylinder housing 32 can flow into the return chamber 15 via the charge hole 35 and air hole 34. The other proportion of the air will be exhausted to the outer atmosphere via an exhausting vent 16 at a bottom portion of the gun body 1. A thickness of the work part 8 or the height of the though hole 81 will be reflected by the position of the safety slide pole 6 and the knocking base 61. The valve bolt 54 of the control valve 5 will detect the height to guide the high pressure air coming from the main air flow passage 11 to hit the nail 7.

When the trigger 44 is released (shown in FIG. 11), the shuttling valve 41 will be driven to move up by the high pressure air coming from the pressure collecting chamber 10 to shut off the air inlet passage 45 and open the air outlet passage 46. The high pressure air in the pressure collecting chamber 10 can not continuously enter into the main air flow passage 11, control valve 5 and the main air chamber 24 via trigger valve 4. The high pressure air in the main air chamber 24, main air flow passage 11 and the control valve 5 is exhausted to the outer atmosphere. The sliding sleeve 22 with the lower valve 23 is driven by the high pressure air coming from the upper pressure collecting chamber 101 to move down again to shut off the air hole 21 (shown in FIG. 12). The upper valve 25 is driven to open the exhausting passage 27. The remaining air in the upper cylinder housing 31 will be exhausted to the outer atmosphere via the exhausting passage 27 to the exhausting vent 14. The high pressure air collecting in the return chamber 15 will enter into the lower cylinder housing 32 via air hole 34 to drive the pistol 30 to return to the original position.

When the thickness of the work part 8 or the height of the through hole 81 is higher than the predetermined height h, the downward travel distance of the safety slide pole 6 will decrease. Then the trigger 44 is pulled to open the trigger valve 4 (shown in FIG. 13). The high pressure air in the pressure collecting chamber 10 will also enter into the inlet opening 51 via the air inlet passage 45 and the front air flow passage 111 to drive the valve bolt 54 to move down. The safety slide pole 6 and the knocking base 61 are driven to move down. The knocking base 61 is stopped by the work part 8 at the position where a distance between a distal end of the knocking base 61 and the working piece 80 is higher than the predetermined height h. The valve bolt 54 will move down with the movement of the safety slide pole 6. The valve plug 542 of the valve bolt 54 reaches to the neck hole 531 on top of the air guiding hole 530. A passageway between the inlet opening 51 and the outlet opening 52, and a passageway between the inlet opening 51 and the bottom air chamber 56 are shut off. The main air flow passage 11 is closed and the nail hitting of the nail gun is braked.

When the thickness of the work part 8 or the height of the through hole 81 is thinner or shorter than the predetermined height h, the travel distance of the safety slide pole 6 will increase. Then the trigger 44 is pulled to open the trigger valve 4 (shown in FIG. 14). The high pressure air in the pressure collecting chamber 10 will also enter into the inlet opening 51 via the air inlet passage 45 and the front air flow passage 111 to drive the valve bolt 54 to move down. The safety slide pole 6 and the knocking base 61 are driven to move down. The knocking base 61 is stopped by the work part 8 at the position where a distance between the distal end of the knocking base 61 and the working piece 80 is shorter than the predetermined height h. The valve bolt 54 will move down with the movement of the safety slide pole 6. The valve plug 542 reaches to the through hole 532. The inlet opening 51 communicates with the outlet hole 59 via the neck hole 531 and the through hole 532. As a result, the high pressure air is introduced into the bottom air chamber 56 to drive the valve cover 53 to move up. The upward movement of valve cover 53 closes the fluid communication between the inlet opening 51 and the outlet opening 52. In other words, the high pressure air from the air inlet passage 45 can not enter into the main air chamber 24 via the inlet opening 51, the air guiding hole 530 and the outlet opening 52. The main air flow passage 11 is closed and the nail hitting of the nail gun is braked. At the same time, the intermediate chamber 58 communicates with the outlet opening 52 and the outlet hole 59. The remaining air in the main air chamber 24 is exhausted to the outer atmosphere via the back air flow passage 112, the annular air chamber 57, the outlet opening 52, the intermediate chamber 58 and the outlet hole 59 to ensure the closure of the lower valve 23. Further, when the work piece 80 is nailed directly, the safety slide pole 6 and the knocking base 61 reach to the position where a distance between the distal end of the knocking base 61 and the working piece 80 exceeds the predetermined height h, the valve plug 542 driven by the valve bolt 54 reaches to the through hole 532 as the state described above. The nail hitting of the nail gun is braked.

The valve cover 53 and the valve bolt 54 are driven by the high pressure air. The high pressure air can enhance the operation stability of the nail gun. The passageway has the through hole 532 and the neck hole 531 with different diameters configured therein. Further, the solid valve bolt 54 can open or close the passageway for simplifying the construction of the nail gun. No militated element can be seen from outside between the valve bolt 54 and the safety slide pole 6.

Figure 15:
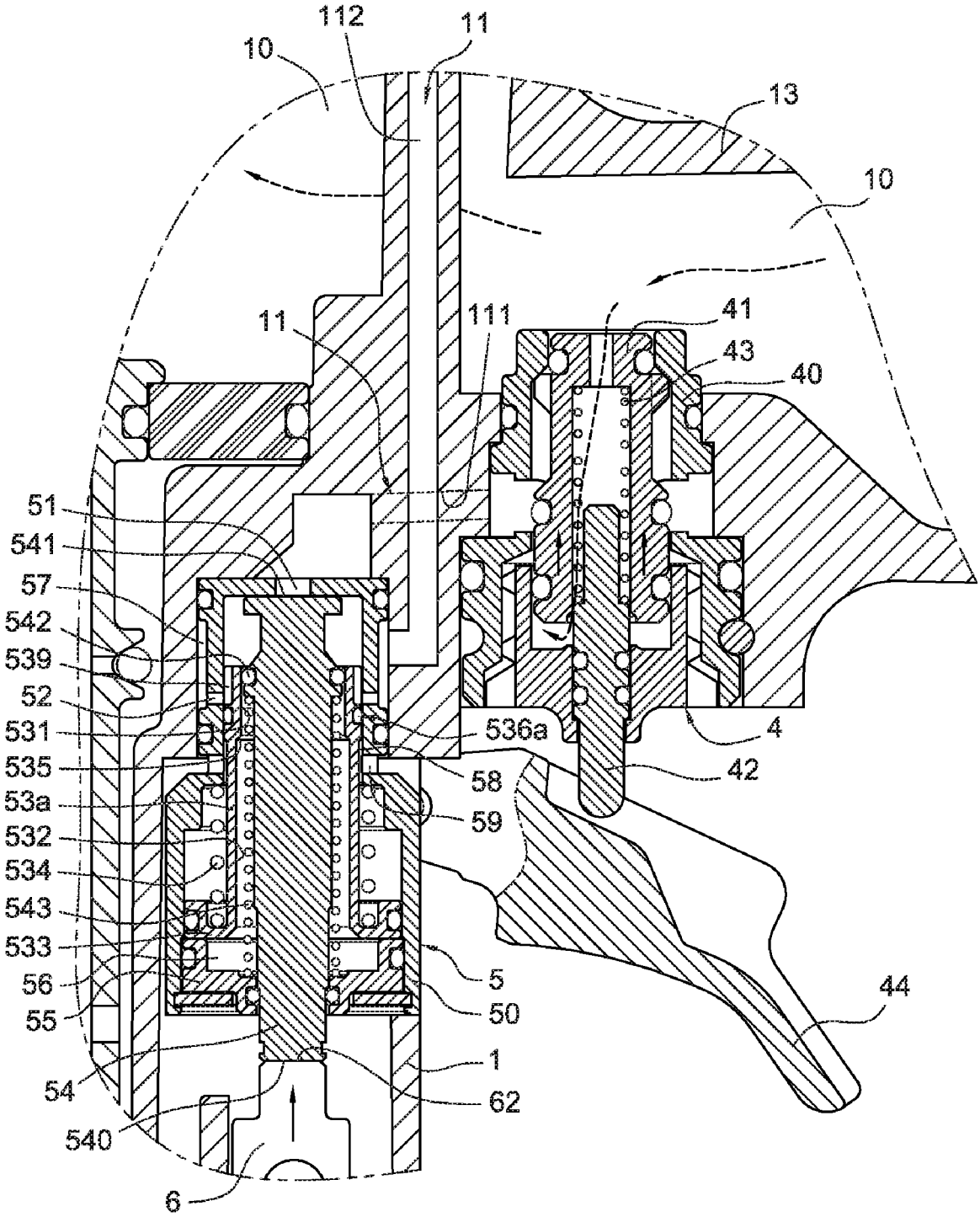
FIG. 15 is a cross-sectional view of a pneumatic nail gun according to a second preferred embodiment of the present invention.
Figure 17:
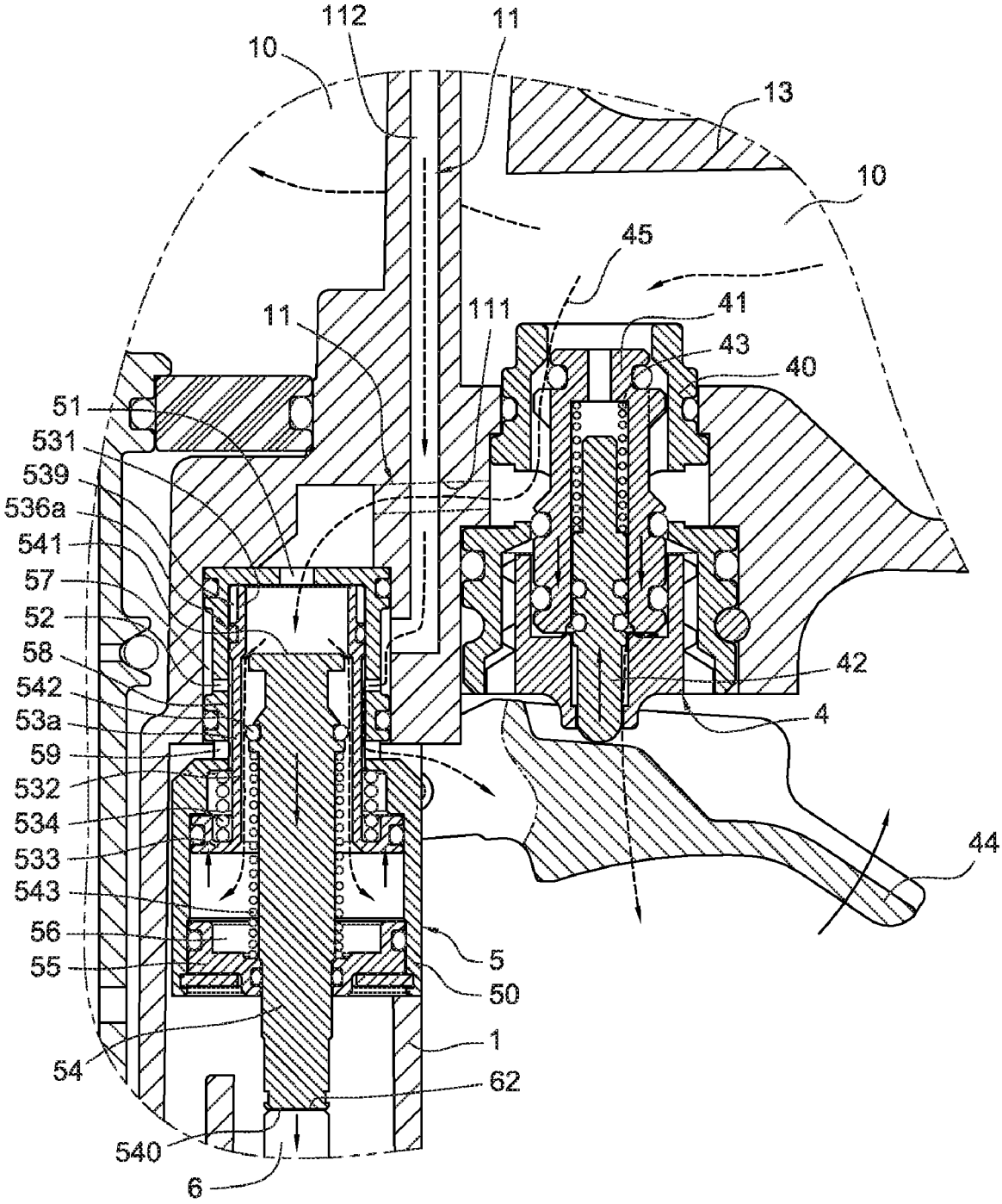
FIG. 17 is similar to FIG. 15, but showing another state of operation.

Referring also to FIG. 15, a second embodiment of the present invention is illustrated. The inlet opening 51 of the valve base 50 and the outlet opening 52 is connected. The air guiding hole in an inner wall of the neck hole 531 is omitted. At least one end slot 539 is defined in a top portion of a valve cover 53*a*. The end slot 539 connects the inlet opening 51 to the outlet opening 52. A plug portion 536*a* can open or close the fluid communication between the inlet opening 51 and the outlet opening 52, or the fluid communication between the end slot 539 and the outlet opening 52. The plug portion 536*a* includes a sealing gasket. The sealing gasket can be moved to a lower position of the outlet opening 52 by the valve cover 53*a* so that the inlet opening 51, the end slot 539 and the outlet opening 52 are communicated. The sealing gasket can also be moved up to an upper position of the outlet 52 (shown in FIG. 17) to close the fluid communication between the inlet opening 51, the end slot 539 and the outlet opening 52.

Figure 16:
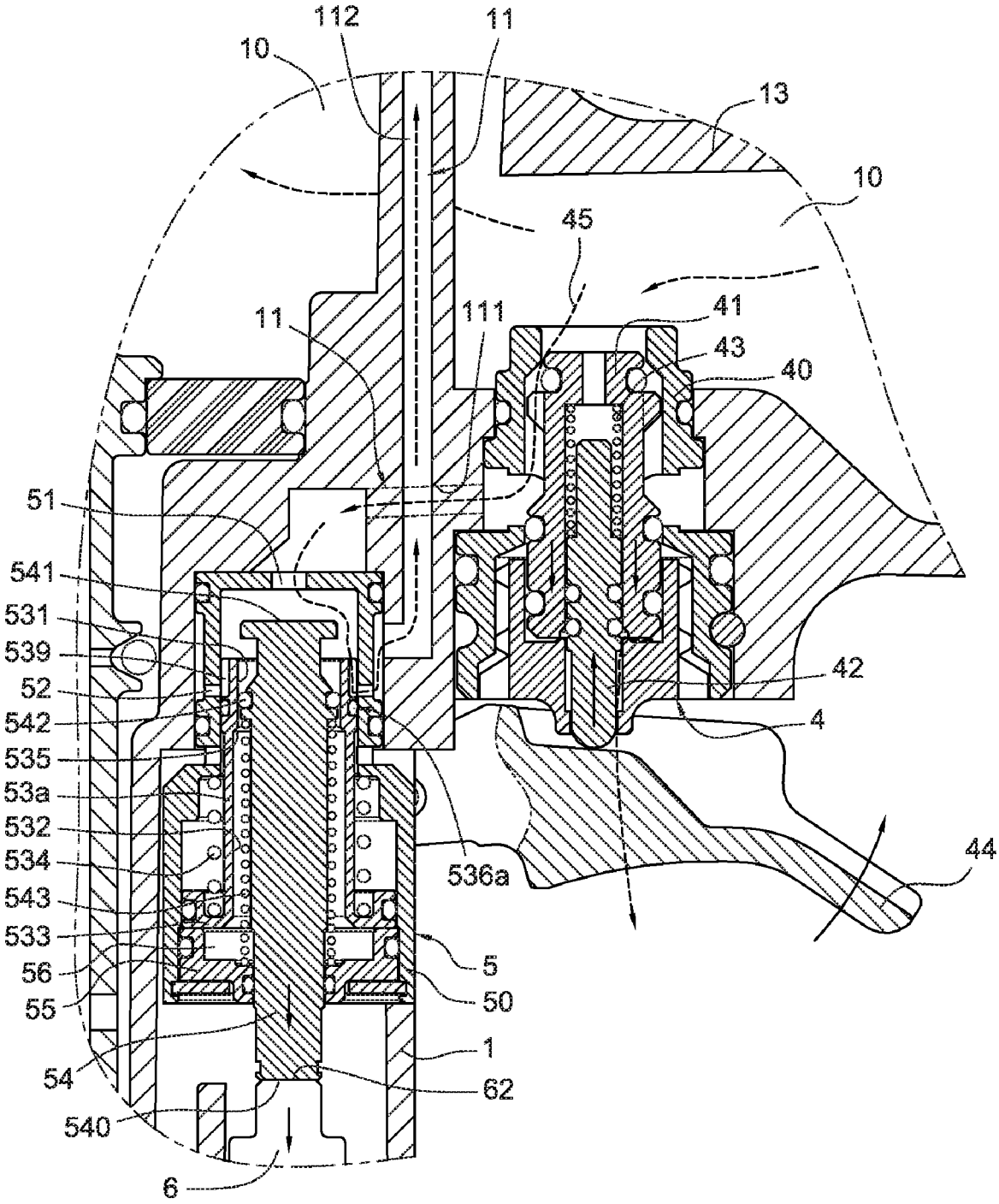
FIG. 16 is similar to FIG. 15, but showing a state of operation.

When the thickness of the work part 8 or the height of the through hole 81 is equal to the predetermined height h, the safety slide pole 6 and the knocking base 61 are driven to move down. The knocking base 61 is stopped by the work part 8 at the position where a distance between the distal end of the knocking base 61 and the working piece 80 is equal to the height h (shown in FIG. 16). The valve plug 542 does not reach the neck hole 531 of the slope 535. The fluid communication between the inlet opening 51 and the bottom air chamber 56 is closed. The high pressure air can flow into the back air flow passage 112 via the inlet opening 51, the end slot 539 and the outlet opening 52 to hit nail. When the thickness of the work part 8 or the height of the through hole 81 is shorter than the predetermined height h, the safety slide pole 6 and the knocking base 61 are driven to move down. The knocking base 61 is stopped by the work part 8 at the position where a distance between the distal end of the knocking base 61 and the working piece 80 is shorter than the height h (shown in FIG. 17). The valve bolt 54 will move down with the movement of the safety slide pole 6. The valve plug 542 reaches the through hole 532 to open the fluid communication between the inlet opening 51 and the bottom air chamber 56. The high pressure air can flow into the bottom air chamber 56 to drive the valve cover 53*a* to move up. The fluid communication between the inlet opening 51, the end slot 539 and the outlet opening 52 is closed. The main air flow passage 11 is shut off. The operations in other ways are same as the first embodiment of the invention.

Figure 18:
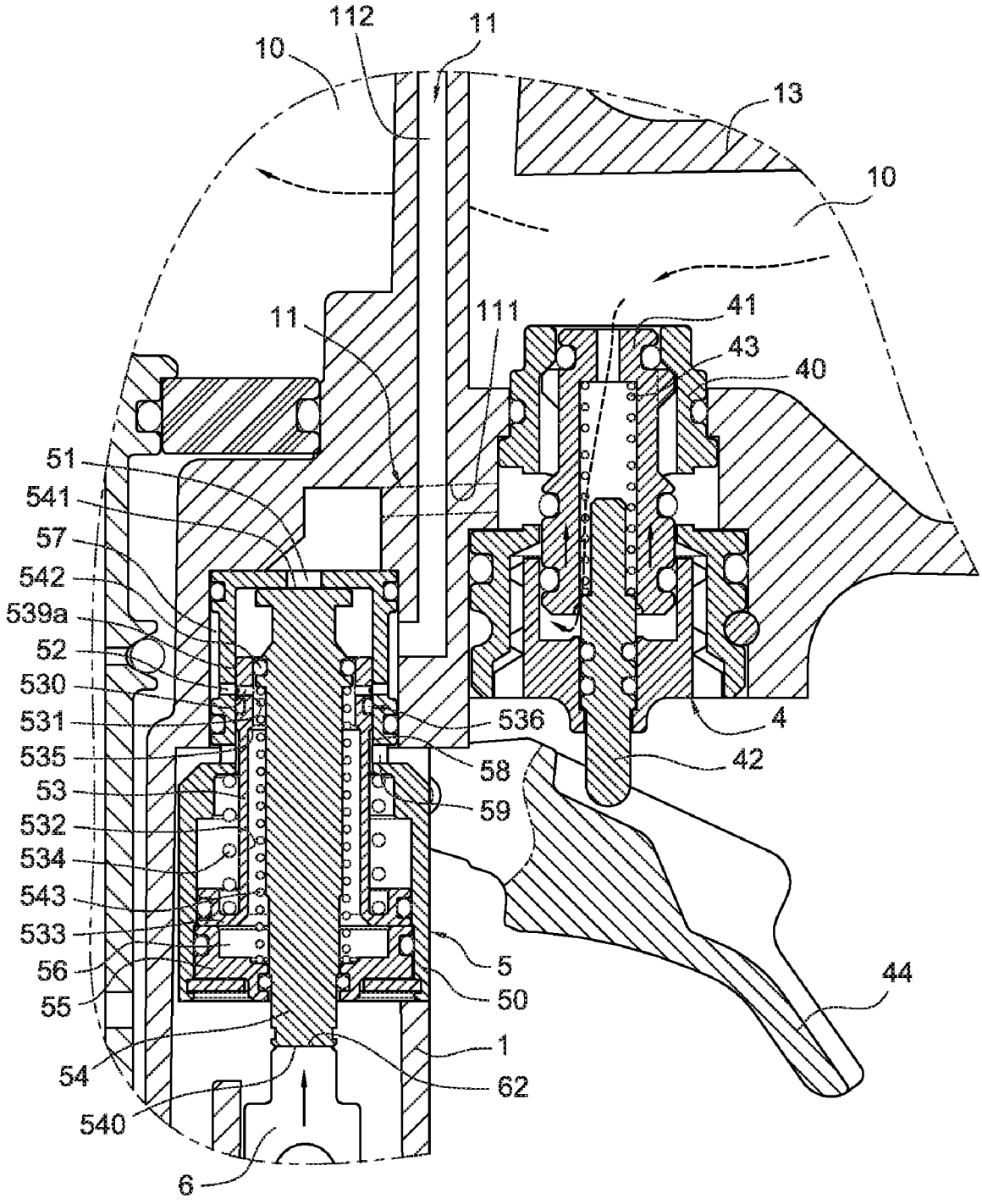
FIG. 18 is a cross-sectional view of a pneumatic nail gun according to a third preferred embodiment of the present invention.

Referring also to FIG. 18, a third embodiment of the invention is illustrated. The sealing gasket 537 on top of the air guiding hole 530 of the plug portion 536 can be omitted (shown in FIG. 6). At least one annular gap 539*a* communicating the inlet opening 51 and the outlet opening 52 is defined in an outer wall on a top portion of the valve cover 53. The other components of the invention are same as the first embodiment of the invention.

Figure 19:
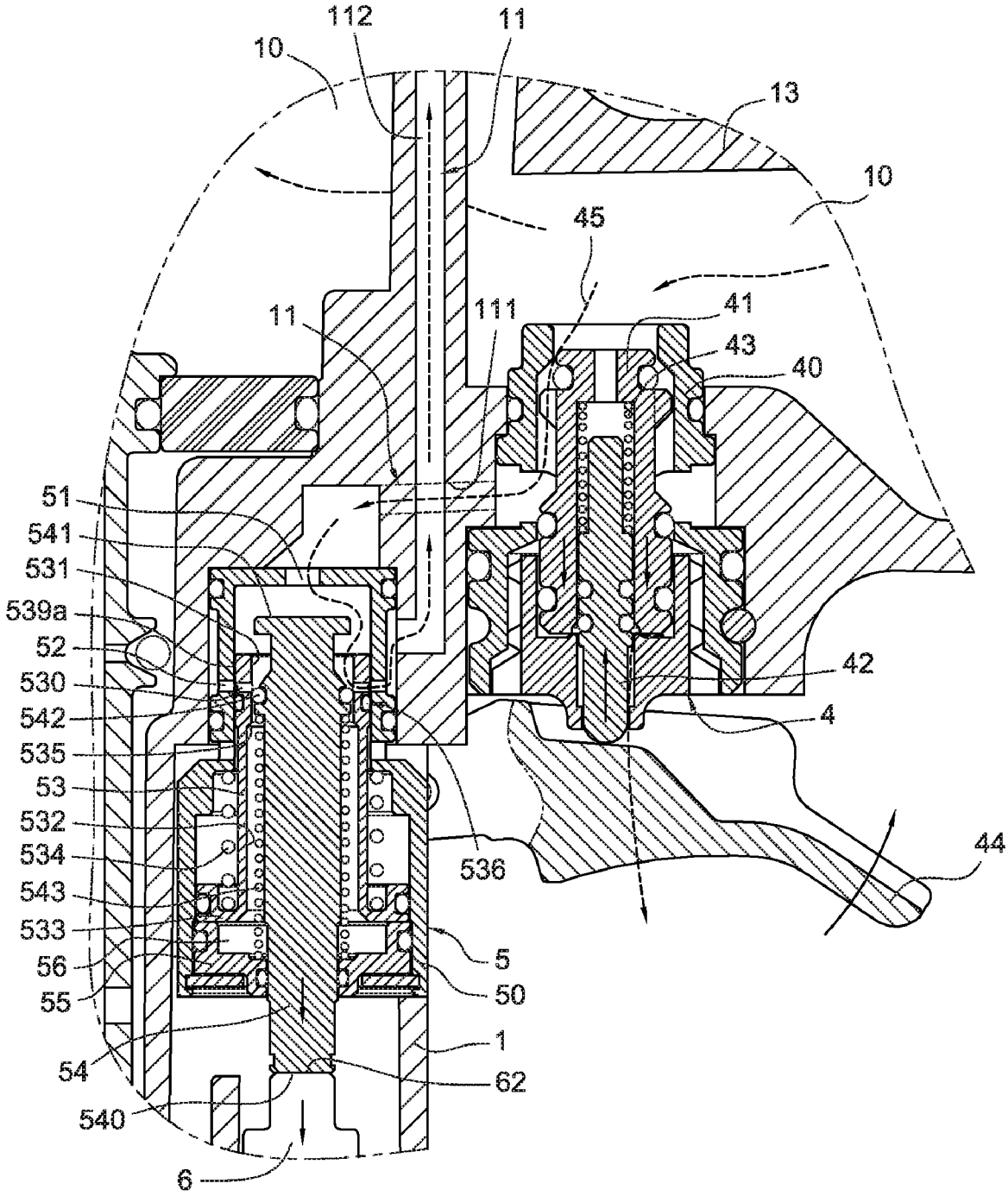
FIG. 19 is similar to FIG. 18, but showing a state of operation.
Figure 20:
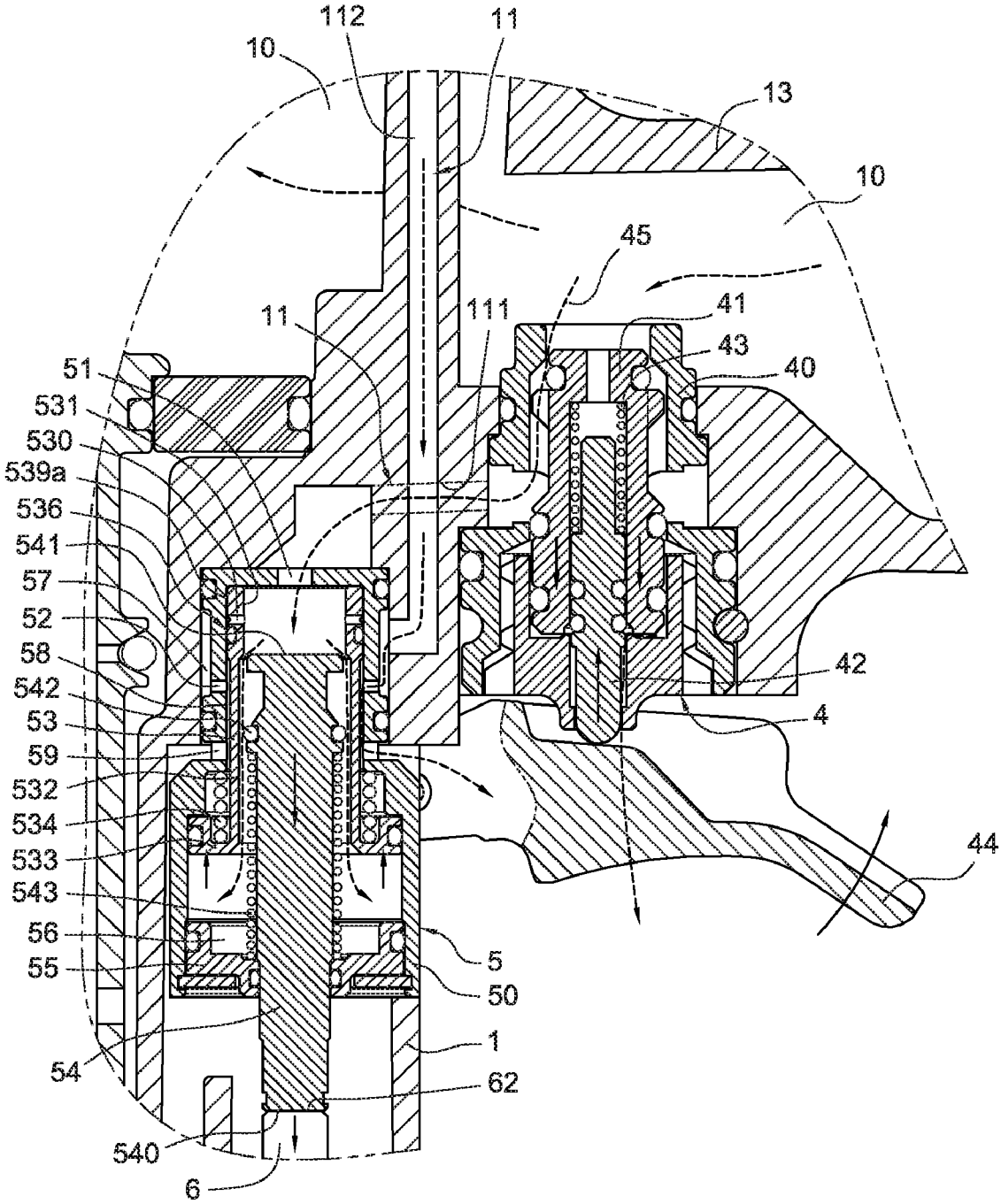
FIG. 20 is similar to FIG. 18, but showing another state of operation.

The safety slide pole 6 is driven to move down. The safety slide pole 6 is stopped at a position where a distance between the distal end of the knocking base 61 and the working piece 80 is equal to the predetermined height h (shown in FIG. 19). The valve bolt 54 will move down with the movement of the safety slide pole 6. The valve plug 542 does not move beyond the neck hole 531 of the slope 535. The fluid communication between the inlet opening 51 and the bottom air chamber 56 is shut off. The high pressure air can flow into the back air flow passage 112 via the inlet opening 51, annular gap 539*a*, air guiding 530 and the outlet opening 52 to hit nail. When the safety slide pole 6 is stopped at a position where a distance between the distal end of the knocking base 61 and the working piece 80 is shorter than the predetermined height h (shown in FIG. 20). The valve 542 move into the through hole 532. The fluid communication between the inlet opening 51 and the bottom air chamber 56 is open. The high pressure air is guided to the bottom air chamber 56 so that the valve cover 53 is driven to move up. The fluid communication between the inlet opening 51 and the outlet opening 52, the annular gap 539*a* and the outlet opening 52, the air guiding hole 530 and the outlet opening 52 are shut off. The main air flow passage 11 is shut off. The operations in other ways are same as the first embodiment of the invention.

Figure 21:
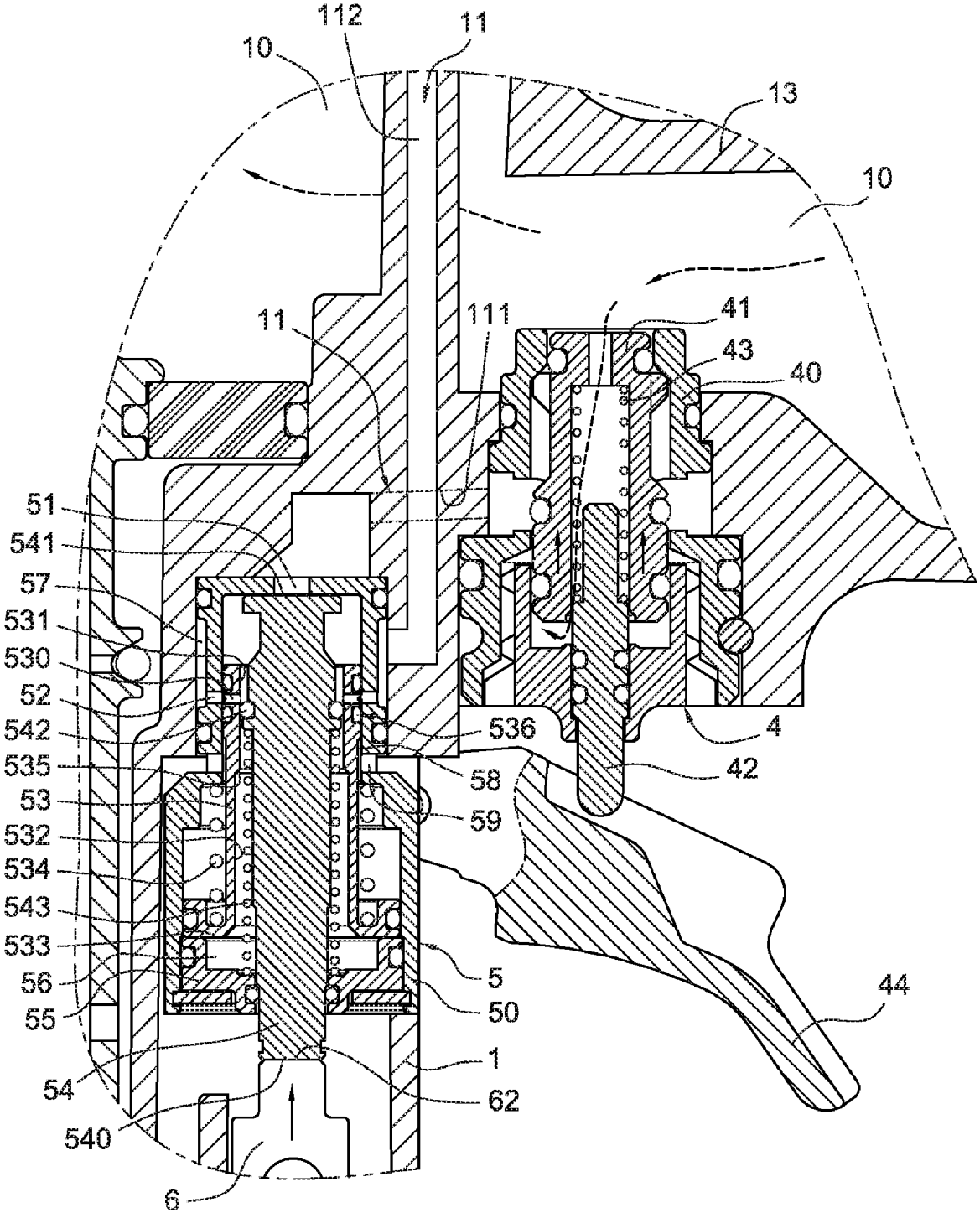
FIG. 21 is a cross-sectional view of a pneumatic nail gun according to a fourth preferred embodiment of the present invention.

Referring also to FIG. 21, a fourth embodiment of the invention is illustrated. The valve bolt 54 is disposed at a top position. The valve plug 542 on outer wall of the valve bolt 54 may slidably set in the neck 531 below the air guiding hole 530 to block the high pressure air from flowing into the bottom air chamber 56. The outlet opening 52 is connected to the inlet opening 51, the neck hole 531 and the air guiding hole 530. The other components of the invention are same as the first embodiment of the invention.

Figure 22:
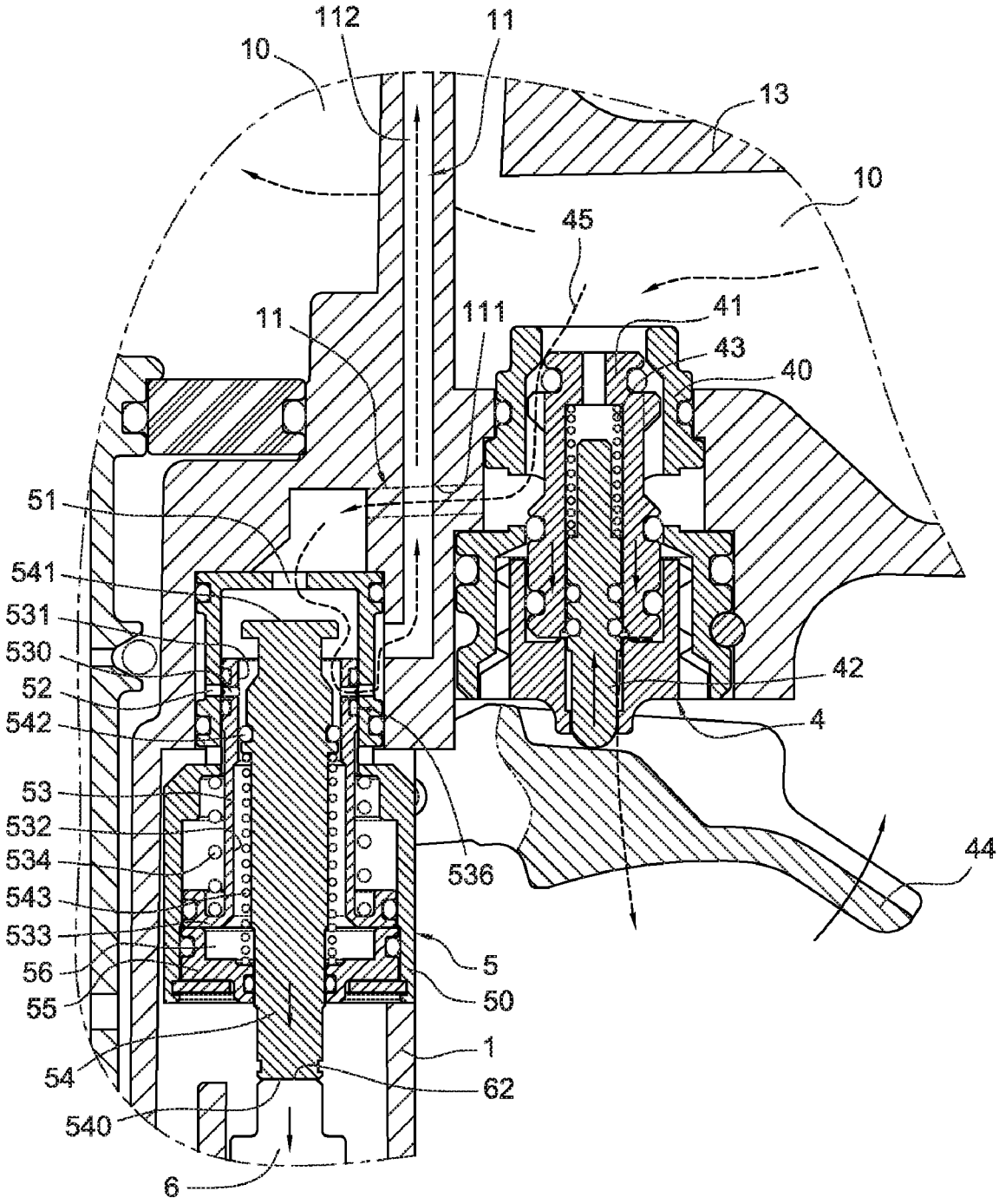
FIG. 22 is similar to FIG. 21, but showing a state of operation.
Figure 23:
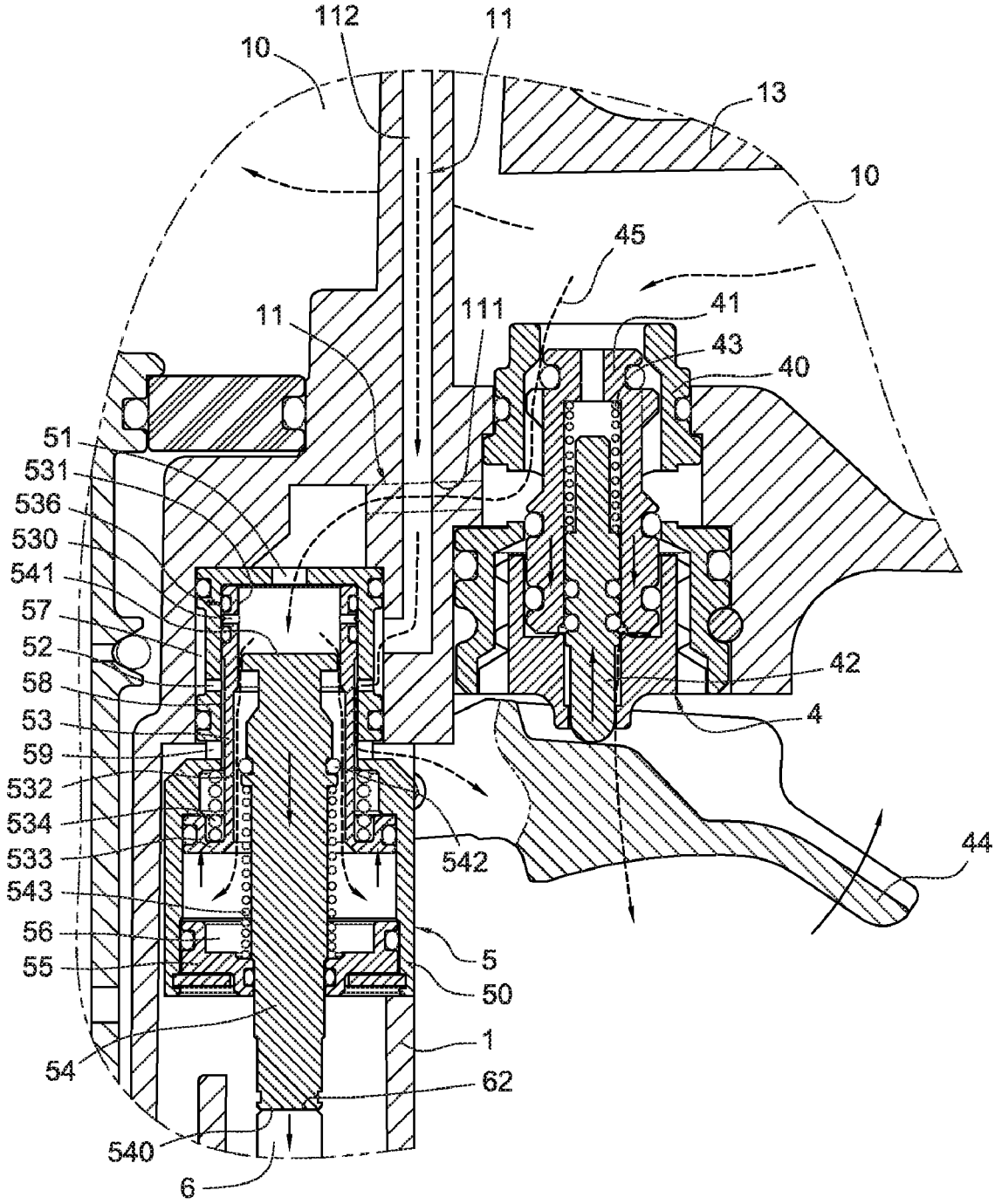
FIG. 23 is similar to FIG. 21, but showing another state of operation.

The safety slide pole 6 is driven to move down. The safety slide pole 6 is stopped at a position where a distance between the distal end of the knocking base 61 and the working piece 80 is equal to the predetermined height h (shown in FIG. 22). The valve bolt 54 moves down with the movement of the safety slide pole 6. The valve plug 542 moves into the neck hole 531 below the air guiding hole 530. The fluid communication between the inlet opening 51 and the bottom air chamber 56 is shut off. The high pressure air can be guided into the back air flow 112 via the inlet opening 51, the neck hole 531, the air guiding hole 530 and the outlet opening 52 to hit nail. When the safety slide pole 6 is stopped at a position where a distance between the distal end of the knocking base 61 and the working piece 80 is shorter than the predetermined height h (shown in FIG. 23). The valve plug 542 moves into the through hole 532. The fluid communication between the inlet opening 51 and the bottom air chamber 56 is open. The high pressure air is guided into the bottom air chamber 56 to drive the valve cover 53 to move up. The fluid communication between the inlet opening 51 and the outlet opening 52, and the air guiding hole 530 and the outlet opening 52 are open. The main air flow passage 11 is shut off. The operations in other ways are same as the first embodiment of the invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A control device for nail hitting of a pneumatic nail gun, a trigger valve being disposed in a gun body of the pneumatic nail gun, high pressure air being introduced from a main air flow passage to urge to open a main air valve to hit nails, a safety slide pole disposed in the gun body, and a control valve disposed in the main air flow passage between the trigger valve and the main air valve, the control valve comprising:

a valve base defining an inlet opening in a top portion thereof, the inlet opening communicating with the trigger valve via the main air flow passage, the valve base defining at least one outlet opening in a side wall thereof, the at least one outlet opening communicating with the main air valve via the main air flow passage;

a valve cover disposed in the valve base, the valve cover defining an upper neck hole and a lower through hole, the upper neck hole communicating with the lower through hole, a diameter of the through hole being larger than a diameter of the neck hole, the neck hole communicating with the inlet opening, the valve cover defining at least one air guiding hole in an inner wall thereof communicating with the outlet opening, a bottom air chamber communicating with the through hole disposed between a bottom valve cover and an inner wall of the valve base; and a valve bolt slidably disposed in the valve cover, the valve bolt having a stressed end face at a top portion thereof adjacent to the inlet opening, the valve bolt being capable of moving down driven by the high pressure air exerting on the stressed end face, a bottom portion of the valve bolt extending to a position abutting to a top portion of the safety slide portion, the safety slide pole being capable of moving down pushed by the valve bolt or moving up released by the bolt valve to an original position, the valve bolt having a valve plug at an outer wall of the valve bolt, the valve plug being slidably disposed in the neck hole on top of the air guiding hole to block the high pressure air;

wherein when the safety slide pole moves down to a predetermined height, the valve bolt moves down with the safety slide pole, the valve plug moves into the neck hole below the air guiding hole, the air communication between the inlet opening and the outlet opening is opened, the air communication between the inlet opening and the bottom air chamber is closed, the high pressure air is guided into the main air flow passage to hit nails; when the safety slide pole moves down to a position which is higher than the predetermined height, the valve plug moves into the neck hole on top of the air guiding hole, the air communication between the inlet opening and the outlet opening is closed, the air communication between the inlet opening and the bottom air chamber is open, the main air flow passage is shut off; when the safety slide pole moves down to a position which is lower than the predetermined height, the valve plug moves into the through hole, the air communication between the inlet opening and the bottom air chamber is open, the high pressure air is guided into the bottom air chamber to drive the valve cover to move up, the air communication between the inlet opening and the outlet opening, and the air guiding hole and the outlet opening are closed, and the main air flow passage is shut off.

2. A control device for nail hitting of a pneumatic nail gun as claimed in claim 1, wherein a plug portion is formed on an outside wall of the valve cover, the plug portion is slidably arranged in the valve base, the plug portion is capable of cutting off the air communication between the inner wall of the valve base and an outer wall of the valve cover, and when the air communication between the air guiding hole and the outlet opening is open, the plug portion is capable of preventing the high pressure air from leaking between the air guiding opening and the outlet opening.

3. A control device for nail hitting of a pneumatic nail gun as claimed in claim 2, wherein the plug portion comprises two sealing gaskets, and the air guiding hole is defined between the two sealing gaskets.

4. A control device for nail hitting of a pneumatic nail gun, a trigger valve being disposed in a gun body of the pneumatic nail gun, the high pressure air being introduced from a main air flow passage to urge to open a main air valve to hit nails, a safety slide pole being disposed in the gun body, and a control valve disposed in the main air flow passage between the trigger valve and the main air valve, the control valve comprising:

a valve base defining an inlet opening in a top portion thereof, the inlet opening communicating with the trigger valve via the main air flow passage, the valve base defining at least one outlet opening in a side wall thereof, the at least one outlet opening communicating with the main air valve via the main air flow passage, and the inlet opening communicating with the outlet opening;

a valve cover disposed in the valve base, the valve cover defining an upper neck hole and a lower through hole, the upper neck hole communicating with the lower through hole, a diameter of the through hole being larger than a diameter of the neck hole, the neck hole communicating with the inlet opening, a bottom air chamber communicating with the through hole disposed between a bottom valve cover and an inner wall of the valve base; and a valve bolt slidably disposed in the valve cover, the valve bolt having a stressed end face at a top portion thereof adjacent to the inlet opening, the valve bolt being capable of moving down driven by the high pressure air exerting on the stressed end face, a bottom portion of the valve bolt extending to a position abutting to a top portion of the safety slide portion, the safety slide pole being capable of moving down pushed by the valve bolt or moving up released by the bolt valve to an original position, the valve bolt having a valve plug at an outer wall of the valve bolt, the valve plug being slidably disposed in the neck hole to block the high pressure air;

wherein when the safety slide pole moves down to a predetermined height, the valve bolt moves down with the safety slide pole, the valve plug moves into the neck hole, the air communication between the inlet opening and the bottom air chamber is closed, the high pressure air is guided into the main air flow passage to hit nails via inlet opening and the outlet opening; when the safety slide pole moves down to a position which is lower than the predetermined height, the valve plug moves into the through hole, the air communication between the inlet opening and the bottom air chamber is open, the high pressure air is guided into the bottom air chamber to drive the valve cover to move up, the air communication between the inlet opening and the outlet opening are closed, and the main air flow passage is shut off.

5. A control device for nail hitting of a pneumatic nail gun as claimed in claim 4, wherein a plug portion is formed on an outside wall of the valve cover, the plug portion is slidably arranged in the valve base, and the plug portion is capable of cutting off the air communication between the inner wall of the valve base and an outer wall of the valve cover to open or close the air communication between the inlet opening and the outlet opening.

6. A control device for nail hitting of a pneumatic nail gun as claimed in claim 5, wherein the plug portion comprises a sealing gasket, when the sealing gasket moves down to a position below the outlet opening driven by the valve cover, the air communication between the inlet opening and the outlet opening is open, and when the sealing gasket moves up to a position on top of the outlet opening driven by the valve cover, the air communication between the inlet opening and the outlet opening is closed.

7. A control device for nail hitting of a pneumatic nail gun as claimed in claim 5, wherein an annular intermediate chamber is arranged between the outer valve cover which positioned below the plug portion and the inner wall of the valve base, at least one outlet hole is defined in a side wall of the valve base below the outlet opening, the at least one outlet hole communicates the intermediate chamber with the outer atmosphere, and when the valve cover moves up to close the communication between the inlet opening and the outlet opening, the communication between the outlet opening and the outlet hole, and the communication between the intermediate chamber and the outlet hole are open.

8. A control device for nail hitting of a pneumatic nail gun as claimed in claim 4, wherein the valve cover defines at least one end slot or annular gap in the outer wall of a top portion thereof, and the at least one the end slot or annular gap communicates with the inlet opening and the outlet opening.

9. A control device for nail hitting of a pneumatic nail gun as claimed in claim 4, wherein at least one air guiding hole is defined in an inner wall of the neck hole, the at least one air guiding hole communicates with the outlet opening, and the valve plug is slidably disposed in the neck hole below the air guiding hole for blocking the high pressure air in order to communicate the inlet opening with the outlet opening, and communicate the air guiding hole with the outlet opening.

10. A control device for nail hitting of a pneumatic nail gun as claimed in claim 4, wherein the valve cover is slidably installed in the valve base, and the valve cover may return to the original position by the rebounding of a spring attached thereon.

11. A control device for nail hitting of a pneumatic nail gun as claimed in claim 10, wherein a circular portion extends from a bottom portion of the valve cover, a first spring is attached to the cover, and the first spring abuts to the inner wall of the valve base and the circular portion.

12. A control device for nail hitting of a pneumatic nail gun as claimed in claim 4, wherein the valve bolt is slidably installed in the valve cover, and the valve bolt may return to the original position by the rebounding of a spring attached thereon.

13. A control device for nail hitting of a pneumatic nail gun as claimed in claim 12, wherein a cover is disposed below a bottom portion of the valve bolt, a second spring is attached to the valve bolt, and the second spring abuts to the valve plug and the cover.

14. A control device for nail hitting of a pneumatic nail gun as claimed in claim 4, wherein a fifth spring is attached between a side portion of the safety slide pole and a bottom portion of the gun body, and the fifth spring urges the safety slide pole to move up to abut against the bottom portion of the valve bolt.

* * * * *